US009713343B2

(12) United States Patent
Slurink et al.

(10) Patent No.: US 9,713,343 B2
(45) Date of Patent: Jul. 25, 2017

(54) TOBACCO PROCESSING SYSTEM

(71) Applicant: Sluis Cigar Machinery B.V., Kampen (NL)

(72) Inventors: Oscar Slurink, Heino (NL); Jeroen Aart Jan Slobbe, Epe (NL)

(73) Assignee: Sluis Cigar Machinery B.V., Kampen (NL)

( * ) Notice: Subject to any disclaimer, the term of this patent is extended or adjusted under 35 U.S.C. 154(b) by 132 days.

(21) Appl. No.: 14/442,753

(22) PCT Filed: Nov. 8, 2013

(86) PCT No.: PCT/NL2013/050795

§ 371 (c)(1),
(2) Date: May 14, 2015

(87) PCT Pub. No.: WO2014/077679

PCT Pub. Date: May 22, 2014

(65) Prior Publication Data

US 2015/0335061 A1 Nov. 26, 2015

(30) Foreign Application Priority Data

Nov. 14, 2012 (NL) ..... 2009809

(51) Int. Cl.
*A24B 3/12* (2006.01)
*A24B 15/18* (2006.01)

(52) U.S. Cl.
CPC ..... *A24B 3/12* (2013.01); *A24B 15/18* (2013.01)

(58) Field of Classification Search
CPC .. A24B 3/00; A24B 15/18; A24B 3/12; B01F 15/0229; B01F 12/0275
See application file for complete search history.

(56) References Cited

U.S. PATENT DOCUMENTS 4,887,619 A * 12/1989 Burcham, Jr. ..... A24B 3/04 131/305
5,676,164 A 10/1997 Martin
2011/0005900 A1* 1/2011 Ceci ..... B65B 7/2807 198/614
2012/0125349 A1* 5/2012 Hansson ..... A24B 13/00 131/112

FOREIGN PATENT DOCUMENTS

EP 0273596 A1 7/1988
FR 2179294 A5 11/1973
WO 2012123289 A1 9/2012

* cited by examiner

*Primary Examiner* — Alison L Hindenlang
*Assistant Examiner* — Jamel M Nelson
(74) *Attorney, Agent, or Firm* — Hoffmann & Baron, LLP

(57) ABSTRACT

A tobacco processing system for processing tobacco includes a tobacco mixing device for mixing an additive in the tobacco, a tobacco supplier for supplying the tobacco to the mixing device, and an additive supplier for supplying the additive to the mixing device. The mixing device includes a mixing housing which encloses the tobacco and additive to form a mixing chamber in which the tobacco and additive are mixed and a gas stream unit which is operatively connected to the mixing housing and configured to provide a gas stream which moves the tobacco and additive through the mixing chamber.

17 Claims, 20 Drawing Sheets

TOBACCO PROCESSING SYSTEM

CROSS-REFERENCE TO RELATED APPLICATIONS

This application is the National Stage of International Application No. PCT/NL2013/050795 filed Nov. 8, 2013, which claims the benefit of Netherlands Application No. 2009809, filed Nov. 14, 2012, the contents of which is incorporated by reference herein.

FIELD OF THE INVENTION

The invention relates to a tobacco processing system for processing tobacco, wherein an additive is mixed in the tobacco.

BACKGROUND OF THE INVENTION

In the known devices it tends to be difficult to obtain a sufficient degree of mixing of the tobacco and additive.

SUMMARY OF THE INVENTION

It is an object to provide an improved, or at least alternative, tobacco processing system. This object is achieved with the tobacco processing system according the invention, which processing system comprises;

a tobacco mixing device for mixing an additive in the tobacco, a tobacco supplier for supplying the tobacco to the mixing device, and an additive supplier for supplying the additive to the mixing device, wherein the mixing device comprises a mixing housing which encloses the tobacco additive to form a mixing chamber in which the tobacco and additive are mixed and a gas stream unit which is operatively connected to the mixing housing and configured to provide a gas stream which moves the tobacco and the additive through the mixing chamber.

With the tobacco processing system according the invention, an efficient way of mixing the tobacco and additive is achieved.

In an embodiment of the tobacco processing system, the mixing device is configured to lift the tobacco inside the mixing chamber via the gas stream. This way an even more efficient way of mixing the tobacco and additive is achieved.

In an embodiment of the tobacco processing system, the gas stream unit comprises a controller to control the gas stream in the mixing chamber such that a pulsating gas stream is provided.

In an embodiment of the tobacco processing system, the pulsating gas stream has between 2 and 5 gas stream pulses per second.

In an embodiment of the tobacco processing system, the mixing housing comprises at least one gas opening which is operatively connected with the gas stream unit.

In an embodiment of the tobacco processing system, the at least one gas opening is positioned to create a circulating gas stream in the mixing chamber.

In an embodiment of the tobacco processing system, the mixing housing comprises inner housing walls which define the mixing chamber and are formed to facilitate the circulating flow of the gas stream.

In an embodiment of the tobacco processing system, the at least one gas opening is positioned to create a vortex-like gas stream in the mixing chamber.

In an embodiment of the tobacco processing system, the mixing housing comprises inner housing walls which define the mixing chamber and are formed to facilitate the vortex-like flow of the gas stream.

In an embodiment of the tobacco processing system, the mixing housing comprises multiple gas openings, a length direction and a width direction, and the gas openings are located at a distance from each other in the length direction or the width direction.

In an embodiment of the tobacco processing system, the mixing housing comprises multiple gas openings, a longitudinal axis and the gas openings surround the longitudinal axis.

In an embodiment of the tobacco processing system, the mixing housing comprises at least one further gas opening which is operatively connected to the gas stream unit and positioned to provided a further gas stream in a direction transverse to the gas stream.

In an embodiment of the tobacco processing system, the gas steam unit comprises a further controller which is configured to control the further gas stream in the mixing chamber such that a pulsating further gas stream is provided.

In an embodiment of the tobacco processing system, the pulsating further gas stream has between 5 and 15 gas stream pulses per second.

In an embodiment of the tobacco processing system, the mixing housing is formed by a holding member for holding the tobacco and a closing member placed in a closing positing in which the tobacco is enclosed by the holding member and the closing member.

In an embodiment of the tobacco processing system, the mixing device is configured to provide the gas stream in the mixing chamber while the closing member is located in the closing position.

In an embodiment of the tobacco processing system, the holding member comprise a first inner space wherein the tobacco is positioned, the closing member comprises a second inner space, the mixing chamber is formed by the first inner space and second inner space and the mixing device is configured to lift the tobacco from the first inner space into the second inner space via the gas stream.

In an embodiment of the tobacco processing system, the processing system comprises a dosing device for forming doses of tobacco and a transport device for transporting the doses of tobacco in tobacco holders through at least part of the processing system and the holding member is formed by one of the tobacco holders.

In an embodiment of the tobacco processing system, the mixing device is configured to provide the gas stream in the mixing chamber while the closing member is located in the closing position and moved along with the tobacco holder.

In an embodiment of the tobacco processing system, the mixing device comprises a member mover to place the closing member in the closing position on one of the moving tobacco holders while moving the closing member along with the tobacco holder over a predetermined distance.

In an embodiment of the tobacco processing system, the member mover moves the closing member along an endless path in which, after being moved along with the tobacco holder while being in the closing position, the closing member is moved back in the opposite direction of the movement of the tobacco holders while being located at a distance from the tobacco holders in order to be placed in the closing position on a further one of the tobacco holders and to repeat the cycle.

In an embodiment of the tobacco processing system, the mixing device comprises multiple closing members and the member mover is configured to move the closing members synchronously in the same direction such that the closing members together with several of the tobacco holders form multiple mixing chambers.

In an embodiment of the tobacco processing system, the transport device is a tray transporter and the tobacco holders are trays moved by the tray transporter through at least part of the processing system.

In an embodiment of the tobacco processing system, the transport device is a package transporter and the tobacco holders are tobacco packages moved by the package transporter through at least part of the processing system.

In an embodiment of the tobacco processing system, the tobacco packages are tobacco bins.

In an embodiment of the tobacco processing system, the tobacco bin comprises a bin wall defining a bin opening and the closing member in the closing position is placed on or in the bin opening.

In an embodiment of the tobacco processing system, the additive supplier is configured to add the additive to the tobacco when the tobacco is located in the holding member.

In an embodiment of the tobacco processing system, the additive supplier is configured to add the additive to the tobacco when the tobacco is located in the mixing chamber.

In an embodiment of the tobacco processing system, the additive supplier is configured to add the additive to the tobacco when the tobacco is located in the tobacco holder. This way, the part of the tobacco processing system located upstream of the tobacco holders will not be contaminated with the additive.

In an embodiment of the tobacco processing system, the additive supplier is configured to add the additive to the tobacco when the tobacco is located in the tray.

In an embodiment of the tobacco processing system, the additive supplier is configured to add the additive to the tobacco when the tobacco is located in the tobacco package. This way, only the tobacco package will be contaminated with the additive.

In an embodiment of the tobacco processing system, the additive supplier is configured to add the additive to the tobacco when the tobacco is located in the tobacco bin.

In an embodiment of the tobacco processing system, the additive is added to the tobacco in the mixing chamber via the gas stream.

In an embodiment of the tobacco processing system, the additive is added to the tobacco in the mixing chamber via the further gas stream.

In an embodiment of the tobacco processing system, the volume of the mixing chamber is at least 1.5 times larger than the volume of the tobacco and additive placed in the mixing chamber.

In an embodiment of the tobacco processing system, the volume of the mixing chamber is at most 10 times larger than the volume of the tobacco and additive placed in the mixing chamber.

In an embodiment of the tobacco processing system, the gas stream provided by the gas stream unit is an air stream.

In an embodiment of the tobacco processing system, the gas stream has a velocity of between 20 m/s and 200 m/s when leaving the at least one gas opening.

In an embodiment of the tobacco processing system, the gas stream has a velocity of between 50 m/s and 150 m/s when leaving the at least one gas opening.

In an embodiment of the tobacco processing system, the further gas stream has a velocity of between 20 m/s and 200 m/s when leaving the at least one further gas opening.

In an embodiment of the tobacco processing system, the further gas stream has a velocity of between 50 m/s and 150 m/s when leaving the at least one further gas opening.

In an embodiment of the tobacco processing system, the processing system comprises a dosing device for forming doses of tobacco and a tobacco storage for storage of the tobacco and passing it to the dosing device, the additive supplier is configured to supply the additive into the tobacco storage, and the holder member is formed by the tobacco storage.

Any combination can be made of the features of two or more of the above mentioned embodiments of the tobacco processing system.

The invention further relates to a method of processing tobacco comprising the steps of;

providing a tobacco processing system according to the invention, supplying tobacco into the mixing chamber of the mixing device, supplying an additive into the mixing chamber of the mixing device, providing a gas stream in the mixing chamber with the gas stream unit to move the tobacco and the additive through the mixing chamber.

In an embodiment of the method, the tobacco is lifted inside the mixing chamber via the gas stream.

In an embodiment of the method, the method comprises enclosing the tobacco with the mixing housing formed by the holding member for holding the tobacco and the closing member placed in a closing positing in contact with the holding member to enclose the tobacco.

In an embodiment of the method, the method comprises transporting doses of tobacco in the tobacco holders through at least part of the processing system with the transport device and forming the holder member with one of the tobacco holders.

In an embodiment of the method, the method comprises mixing the tobacco and additive while one of the trays forms the holder member.

In an embodiment of the method, the method comprises mixing the tobacco and additive while one of the tobacco packages forms the holder member.

In an embodiment of the method, the method comprise mixing the tobacco and additive while one of the tobacco bins forms the holder member.

Any combination can be made of the features of two or more of the above mentioned embodiments of method.

BRIEF DESCRIPTION OF THE DRAWINGS

Embodiments of the tobacco processing system and method according the invention will be described by way of example only, with reference to the accompanying schematic drawings in which corresponding reference symbols indicate corresponding parts, and in which.

DETAILED DESCRIPTION OF THE INVENTION

Figure 1:
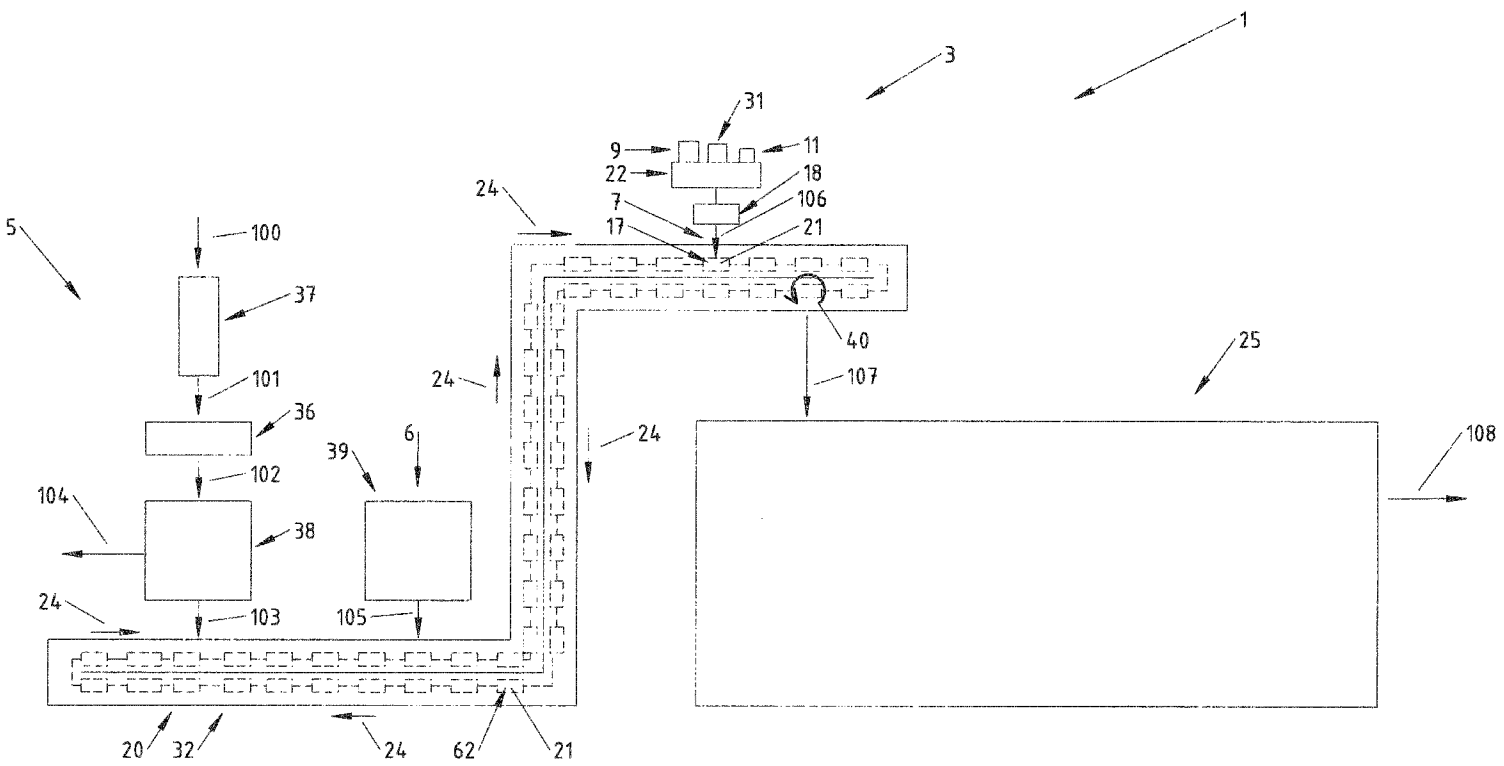
FIG. 1 schematically shows an embodiment of the tobacco processing system according to the invention, FIG. 2 schematically shows a view in perspective of the additive supply unit, transport device and mixing device of a further embodiment of the tobacco processing system according to the invention, the FIGS. 3 and 4*a-d* schematically show the transport device and mixing device of FIG. 2, FIG. 5 schematically shows a view in cross section of the mixing housing of the processing system of FIG. 2, FIG. 6 schematically shows a view in cross section of the mixing housing of a further embodiment of the processing system according to the invention, FIG. 7 schematically shows a view in cross section of the mixing housing of a further embodiment of the processing system according to the invention, the FIGS. 8 and 9 schematically show a view in perspective of the closing member of the processing system of FIG. 2, FIG. 10 schematically shows a view in perspective of the holding member of the processing system of FIG. 2, FIG. 11 schematically shows a further embodiment of the tobacco processing system according to the invention, FIG. 12 schematically shows a view in perspective of the mixing housing of the tobacco processing system of FIG. 11, FIG. 13 schematically shows a view in cross section of the mixing housing of a FIG. 12, FIG. 14 schematically shows a view in perspective of a further embodiment of the mixing housing of the tobacco processing system of FIG. 11, FIG. 15 schematically shows a first view in cross section of the mixing housing of FIG. 14, FIG. 16 schematically shows a second view in cross section of the mixing housing of FIG. 14, and FIG. 17 schematically shows a side view of a further embodiment of the tobacco processing system according to the invention.

FIG. 1 shows an embodiment of the tobacco processing system 1 according to the invention. The tobacco processing system 1 comprises a tobacco storage 37 for storing tobacco. In use, tobacco is supplied into the tobacco storage 37 (arrow 100). This is in general performed mechanically, but may also be performed manually. The tobacco in the tobacco storage 37 is transferred to a dosing device 36 (arrow 101).

The dosing device 36 produces doses of a predetermined amount of tobacco and transfers the doses of tobacco to a weighing device 38 (arrow 102).

The weighing device 38 weighs the doses of tobacco. The approved doses containing the right amount of tobacco are transferred into tobacco holders 62 of a transport device 32 (arrow 103). Each tobacco holder 62 holds one dose of tobacco. The disapproved doses containing a different amount of tobacco are discharged (arrow 104).

The tobacco holders 62 are trays 21, and the transport device 32 is a tray transporter 20 configured to move the trays 21 through the processing system 1. The trays 21 are interconnected to form an endless series of trays 21. The endless chain of trays 21 is circulated along a predetermined path. The direction of the movement of the trays 21 is indicated by the arrows 24.

After receiving a dose of tobacco, the trays 21 are moved to an additive supply unit 39. The additive supply unit 39 discharges a specific amount of additive in the tray 21 and on the tobacco (arrow 105). The additive may be selected to enhance the flavour of the tobacco. The additive may comprise one or more spices and/or one or more herbs. The additive may for example comprise mint and/or ginger and/or sugar. The additive may be in a fluid form or in a solid form containing small particles.

The trays 21 holding the tobacco and additive are subsequently transported to the tobacco mixing device 3. The mixing device 3 comprises a mixing housing 7 which encloses the tobacco and additive to form a mixing chamber 8 in which the tobacco and additive are mixed and a gas stream unit 9 which is operatively connected to the mixing housing 7 and configured to provide a gas stream 10 which moves the tobacco and additive through the mixing chamber 8. This way an effective mixing of the tobacco and additive is achieved.

The tobacco storage 37, dosing device 36 and weighing device 38 form, in cooperation with the transport device 32, the tobacco supplier 5 which supplies the tobacco to the mixing device 3. The additive supply unit 39 forms, in cooperation with the transport device 32, the additive supplier 6 which supplies the additive to the mixing device 3.

The mixing housing 7 is formed by a holding member 17 for holding the tobacco and additive and a closing member 18 placed in a closing positing 19 in which the closing member 18 is in contact with the holder member 17 such that the tobacco and additive is enclosed by the holding member 17 and the closing member 18. The holding member 17 is formed by one of the tobacco holders 62, more specifically one of the trays 21. The mixing device 3 is configured to provide the gas stream 10 in the mixing chamber 8 while the closing member 18 is located in the closing position 19 and moved along with the tray 21. The mixing device 3 comprises a member mover 22 to place the closing member 18 in the closing position 19 on one of the moving trays 21 while moving the closing member 18 along with the tray 21 over a predetermined distance. The predetermined distance is chosen such that there is sufficient time to mix the tobacco and additive with the gas stream 10 provided by the gas stream unit 9. The gas stream unit 9 comprises a controller 11 to control the gas stream in the mixing chamber.

After the mixing, the trays 21 holding the mixed tobacco and additive is transported to a packaging device 25. The mixed tobacco and additive is transferred to the packaging device 25 (arrow 107). The mixed tobacco and additive is transferred by tilting the trays 21 at a specific location above the packaging device 25 (arrow 40).

The packaging device 25 places the doses of tobacco mixed with the additive in tobacco packages. Sealed packages of mixed tobacco and additive leave the packing device 25 (arrow 108).

Figure 2:
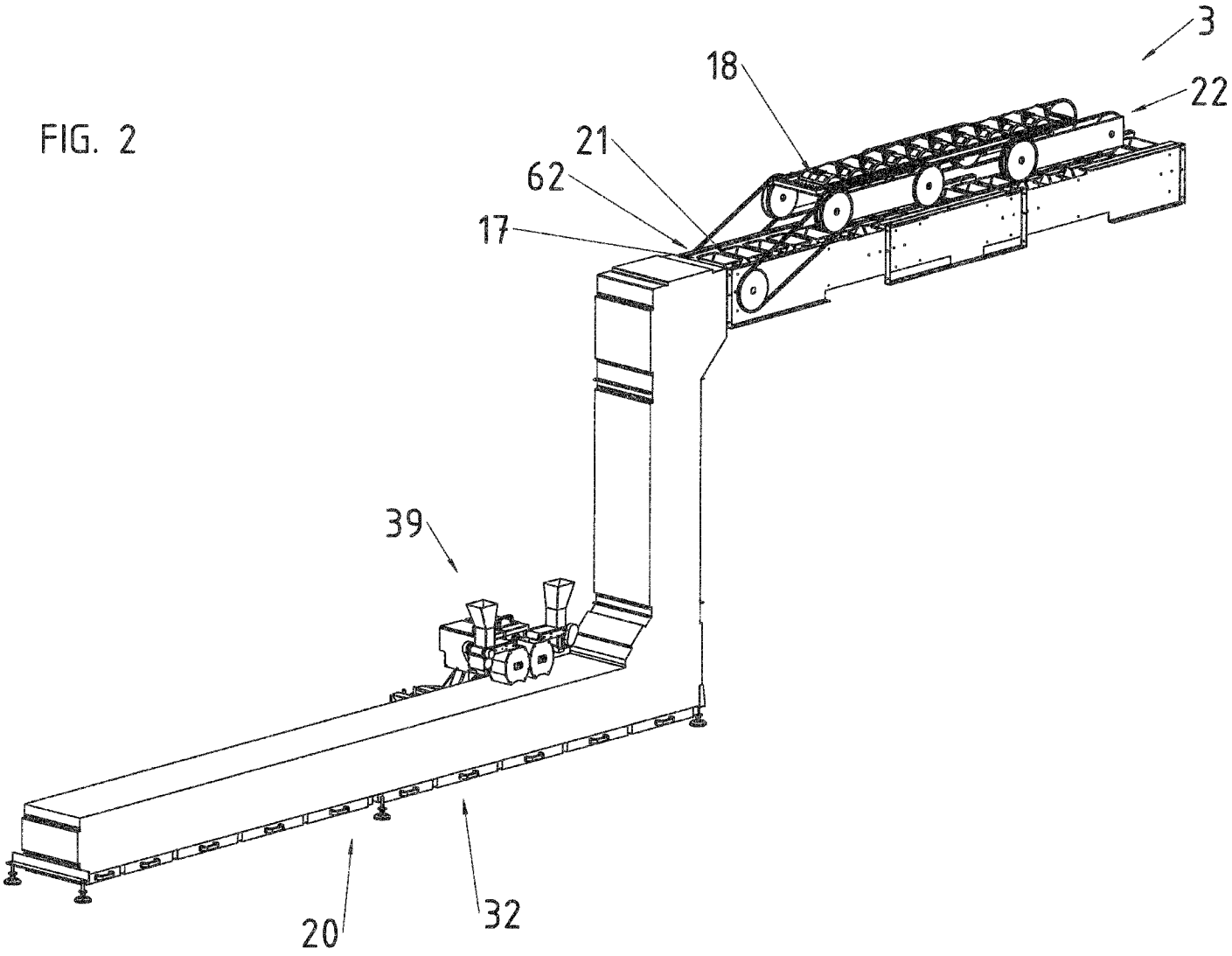
Figure 3:
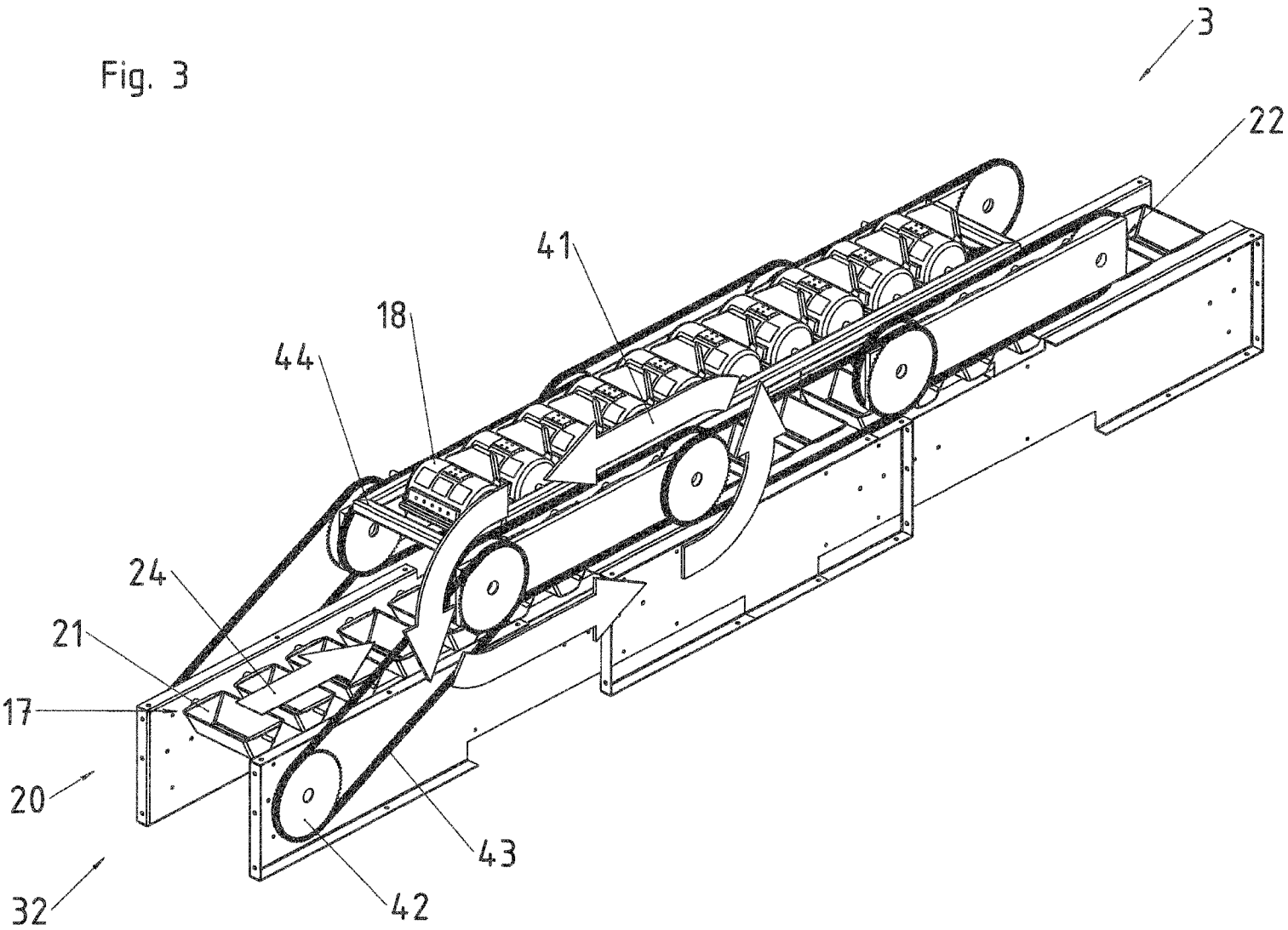

FIG. 2 shows the additive supply unit 39, transport device 32 and mixing device 3 of a further embodiment of the tobacco processing system 1 according to the invention. The processing system 1 of FIG. 2 differs from the one shown in FIG. 1, in that the tobacco mixing device 3 is configured to mix the tobacco and additive of more than one tobacco holders 62, more specifically trays 21, simultaneously.

The FIGS. 3 and 4*a-d* show the transport device 32 and mixing device 3 of FIG. 2. The gas stream unit 9 and controller 11 are not shown in the FIG. 2-4 in order to obtain a detailed view on the functioning of the mixing device 3 and its member mover 22.

The mixing device 3 comprises ten closing members 18 and is configured to mix the tobacco and additive of ten trays 21 simultaneously. The member mover 22 is configured to place each of the closing members 18 in the closing position 19 on one of the moving trays 21 while moving the closing members 18 along with the trays 21 over a predetermined distance. The mixing device 3 is configured to provide the gas stream 10 in the mixing chambers 8 while the closing members 18 are located in the closing position 19 and moved along with the trays 21. The mixing houses 7 of the different mixing chambers 8 may be operatively connected to one or several gas stream units 9.

The member mover 22 moves each of the closing members 18 along an endless path in which, after being moved along with the trays 21 while being in the closing position 19 on one of the trays 21, the closing member 18 is moved back in the opposite direction of the movement of the trays 21 while being located at a distance from the trays 21 in order to be placed in the closing position 19 on a further one of the trays 21 and to repeat the cycle. The endless path of one of the closing members 18 is indicated by the arrows 41. The member mover 22 is configured to move the closing members 18 synchronously in the same direction such that the closing members 18 together with several of the trays 21 form multiple mixing chambers 8.

Figure 4A:
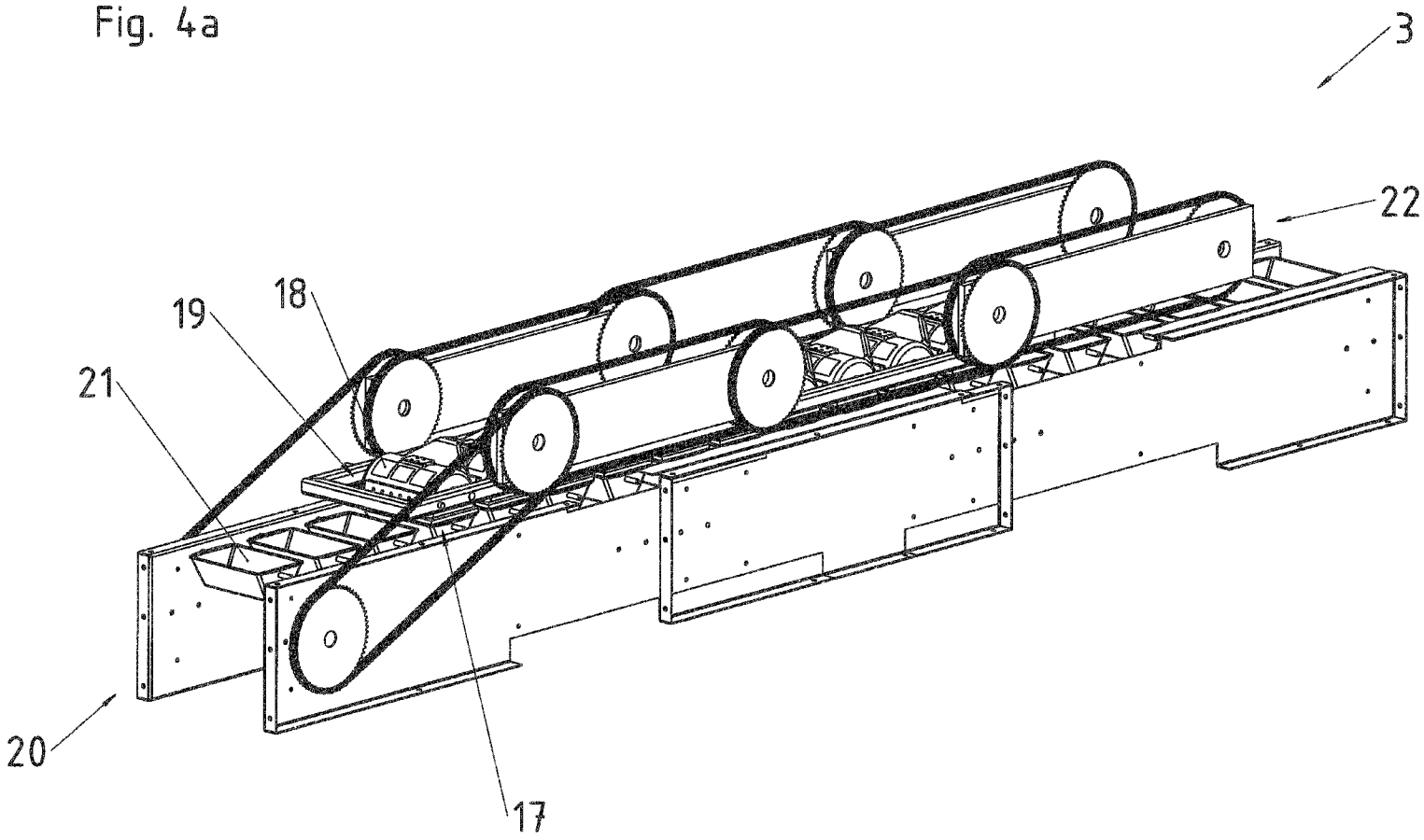
Figure 4B:
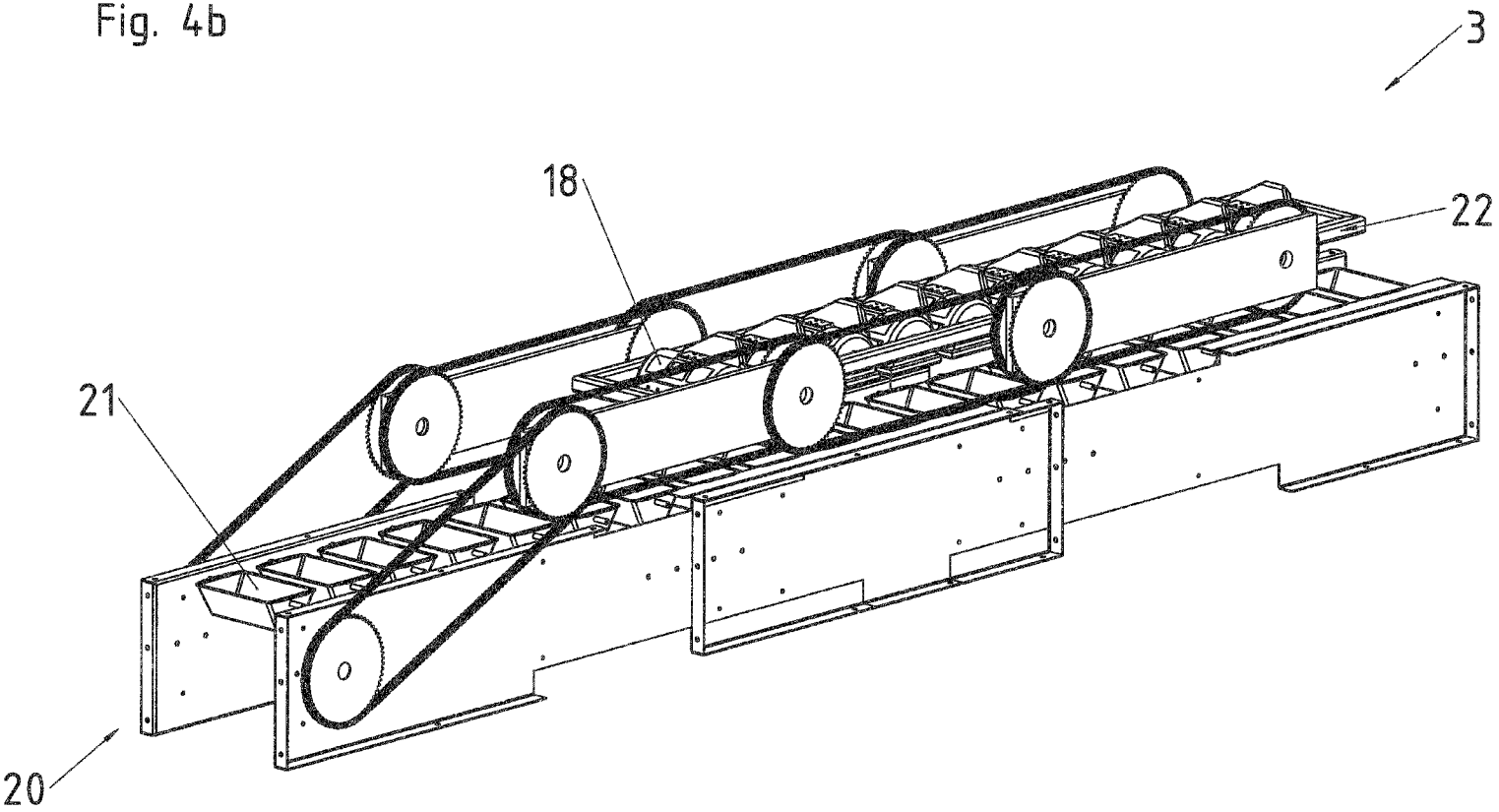
Figure 4C:
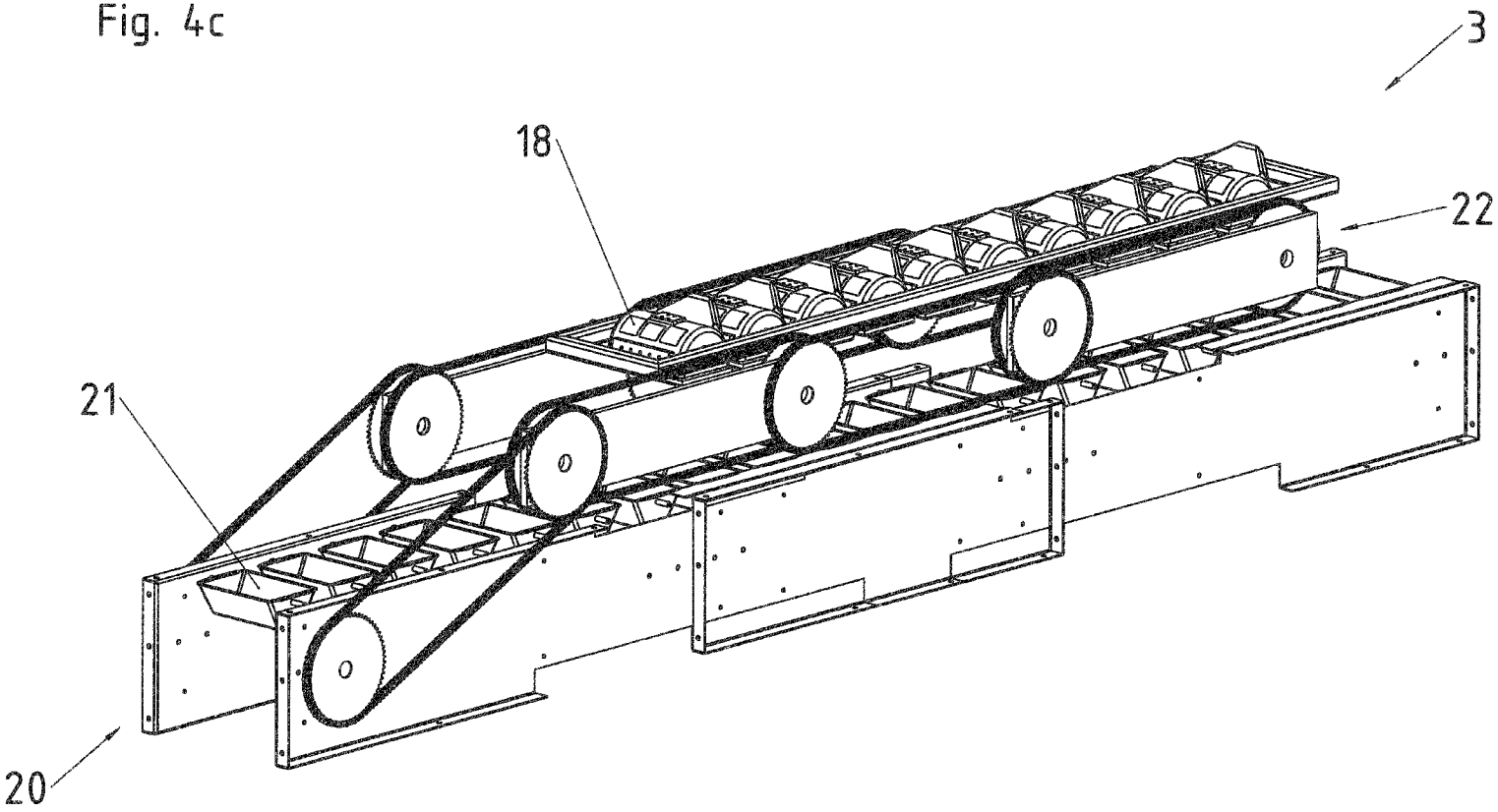
Figure 4D:
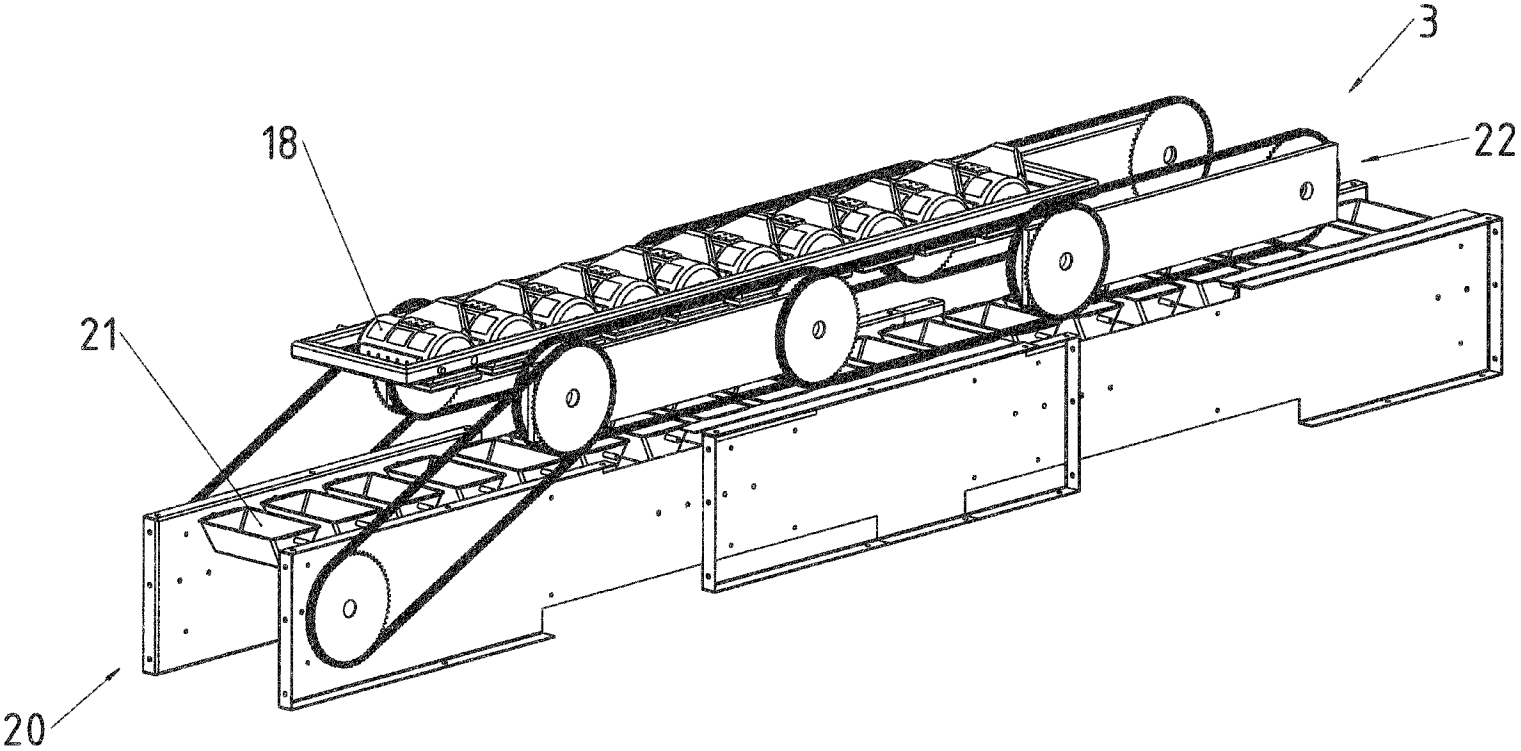

In FIG. 4*a* each of the closing members 18 is placed in the closed position 19 on one of the trays 21 holding the tobacco and additive. From this starting position, the closing members 18 are moved along with the trays 21 over a predetermined distance. During this movement, the gas stream 10 for mixing the tobacco and additive is provided in each of the mixing chambers 8 formed by the closing members 18 in the closing position 19 on the trays 21. After that, the closing members 18 are moved at a distance from the trays 21 holding the mixed tobacco and additive (FIG. 4*b*) and subsequently in the opposite direction of the movement of the trays 21 (FIGS. 4*c* and 4*d*). The closing members 18 will be moved back to the starting position shown in FIG. 4*a*, in which the closing members 18 will be positioned in closing position 19 on the next set of trays 21 to repeat the cycle. The movement of the closing members 18 and the trays 21 are tuned so that every dose of tobacco is processed once. This means that when passing the mixing device 3, no tray 21 is missed of treated more than once.

The closing members 18 are connected to a member frame 44. The member movers 22 comprises gear wheel 42 which are driven by a drive unit (not shown) and are interconnected with gear chains 43. The member frame 44 is connected to several of the gear chains 43 such that the member frame 44 follows the movement of said gear chains 43. This way the closing members 18 move along their endless path. It will be clear to the skilled person that many different arrangements can be used to achieve the required movement of the closing members 18.

Figure 5:
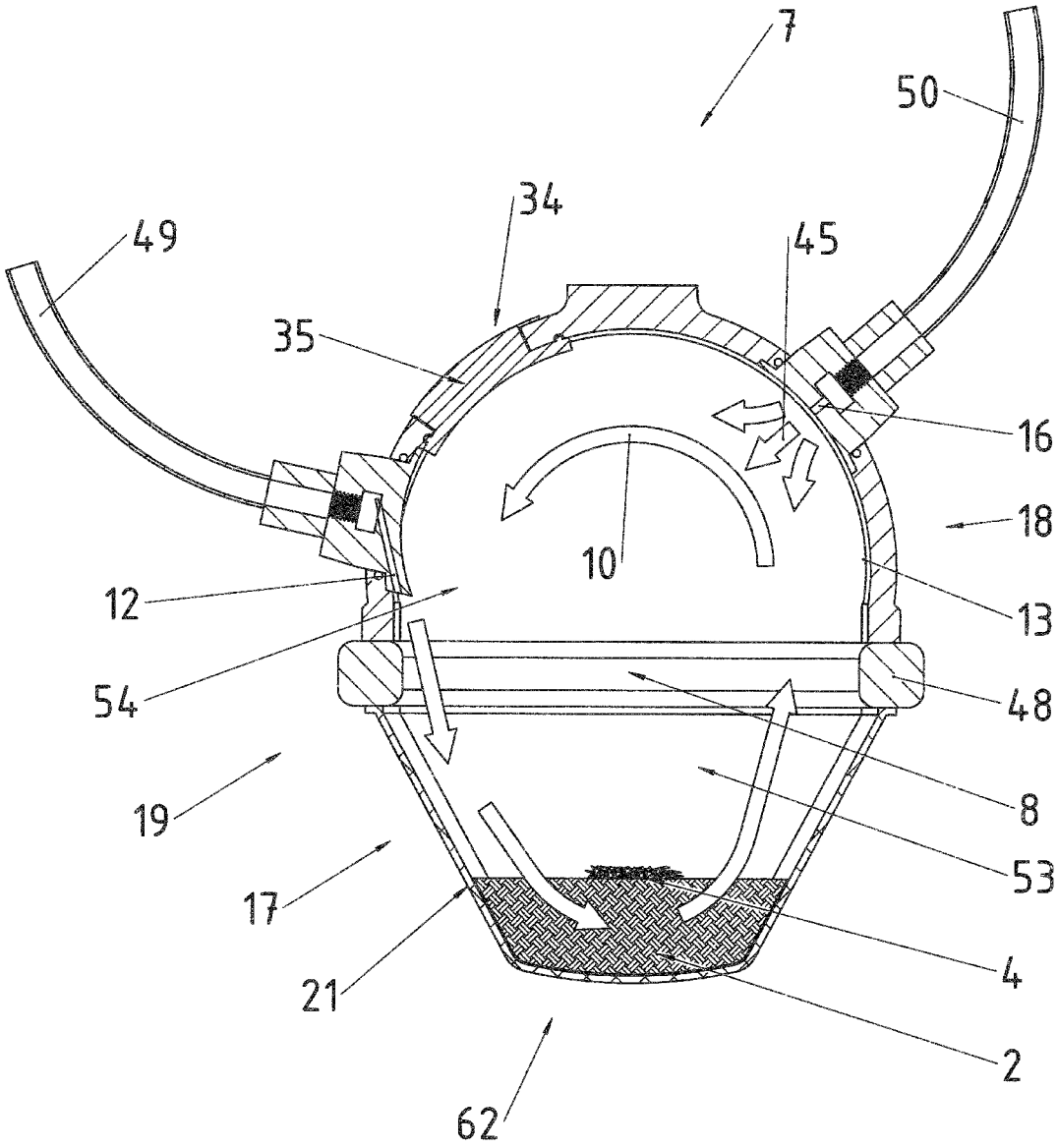

FIG. 5 shows a view in cross section of a mixing housing of the processing system of FIG. 2. The mixing housing 7 is formed by the tray 21 and the closing member 18. The closing member 18 is positioned in the closing position 19, such that the tobacco 2 and additive 4 is enclosed by the tray 21 and the closing member 18. The tray 21 and the closing member 18 define the mixing chamber 8.

The closing member 18 comprises a resilient element 48 which is placed in contact with the tray 21 to seal the mixing chamber 8. The mixing housing 7 comprises gas openings 12 which are operatively connected with the gas stream unit 9 via a gas duct 49. The gas openings 12 are provided in the closing member 18. The gas openings 12 are positioned to create a circulating gas stream (arrows 10) in the mixing chamber 8. The mixing housing 7 comprises inner housing walls 13 which define the mixing chamber 8 and are formed to facilitate the circulating flow of the gas stream.

The tray 21 (as being the holding member 17) comprise a first inner space 53 wherein the tobacco 2 is positioned. The closing member 18 comprises a second inner space 54. The mixing chamber 8 is formed by the first inner space 53 and second inner space 54. The mixing device 3 is configured to lift the tobacco 2 and additive 4 from the first inner space 53 into the second inner space 54 with the gas stream 10.

The gas stream unit 9 comprises a controller 11 to control the gas stream 10 in the mixing chamber 8 such that a pulsating gas stream 10 is provided. The pulsating gas stream has around three gas stream pulses per second. In other examples, the pulsating gas stream has between two and five gas stream pulses per second. This facilitates the mixing of the tobacco 2 and additive 4.

The mixing housing 7 comprises further gas openings 16 which are positioned to provided a further gas stream 45 in a direction transverse to the circulating gas stream 10. This tends to create an improved mixing of the tobacco 2 and additive 4 in the mixing chamber 8. The gas openings 12 and further gas openings 16 extend transverse to each other. The further gas openings 16 are located in the closing member 18. The further gas openings 16 are operatively connected to the gas stream unit 9 via a further gas duct 50. The gas steam unit 9 comprises a further controller 31 is configured to control the further gas stream 45 in the mixing chamber 8 such that a pulsating further gas stream 45 is provided. The pulsating further gas stream has around ten gas stream pulses per second. In other examples, the pulsating further gas stream has between five and fifteen gas stream pulses per second.

The mixing housing 7 comprises a vent opening 34 to release an overpressure in the mixing chamber 8. The vent opening 34 is provided with a filter 35 to ensure that gas can pass through the vent opening 34 and the tobacco 2 and additive 4 remain in the mixing chamber 8.

The gas steam 10 and further gas stream 45 have a velocity of around 120 m/s when leaving the gas openings 12 and further gas openings 16, respectively. In other examples of the processing system, the gas stream 10 and further gas stream 45 have a velocity of between 20 m/s and 200 m/s. In a further embodiment, the gas stream 10 and further gas stream 45 have a velocity of between 50 m/s and 150 m/s.

The gas stream 10 and further gas stream 45 are air streams.

In the embodiment of FIG. 5, the additive is added to the tobacco when the tobacco is located in the holding member 17, more specifically the tobacco holder 62. The additive supplier discharges the additive 4 in the holding member 17, more specifically the tobacco holder 62, before the closing member 18 is placed in the closing position 19.

Figure 6:
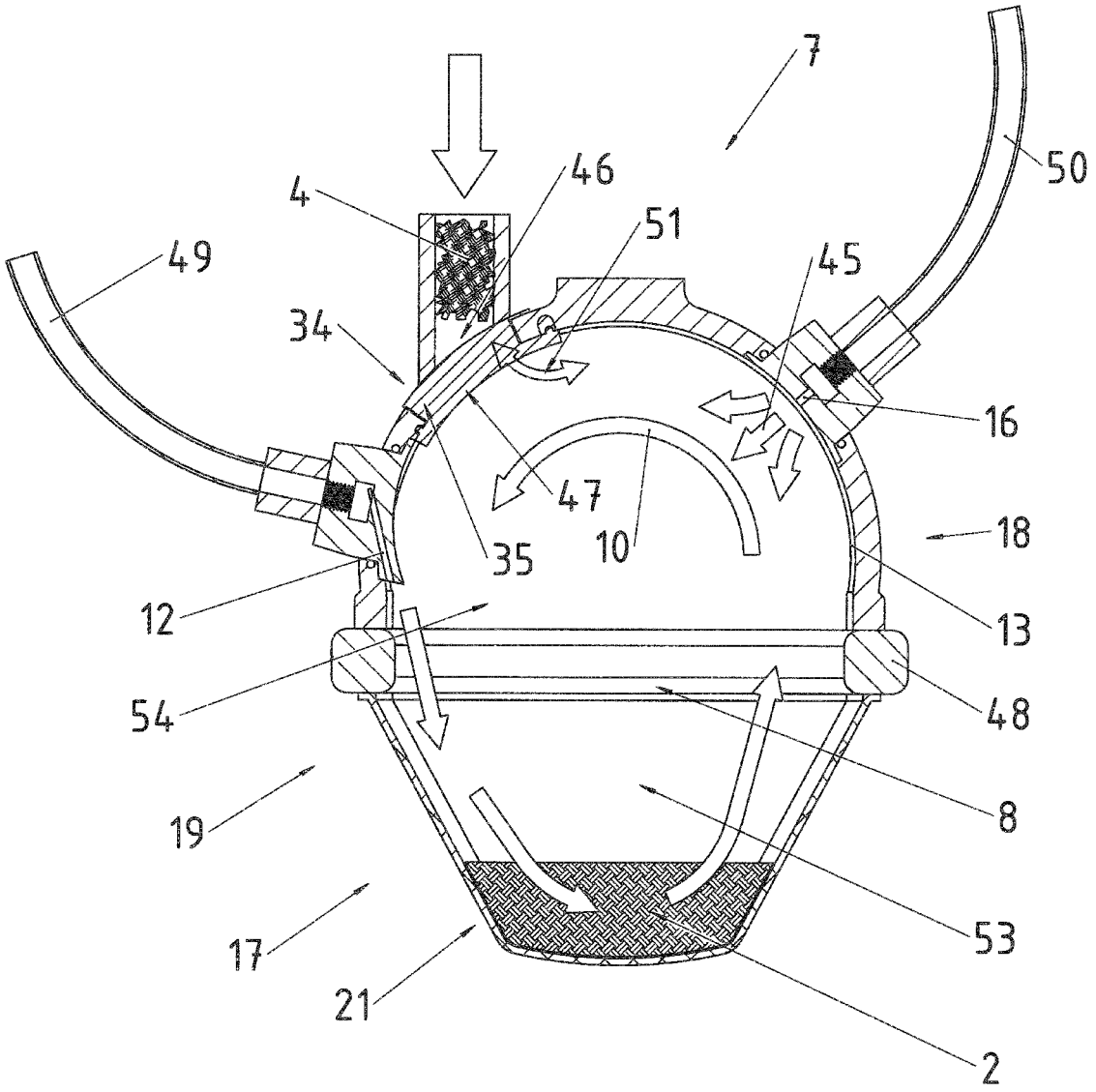
Figure 7:
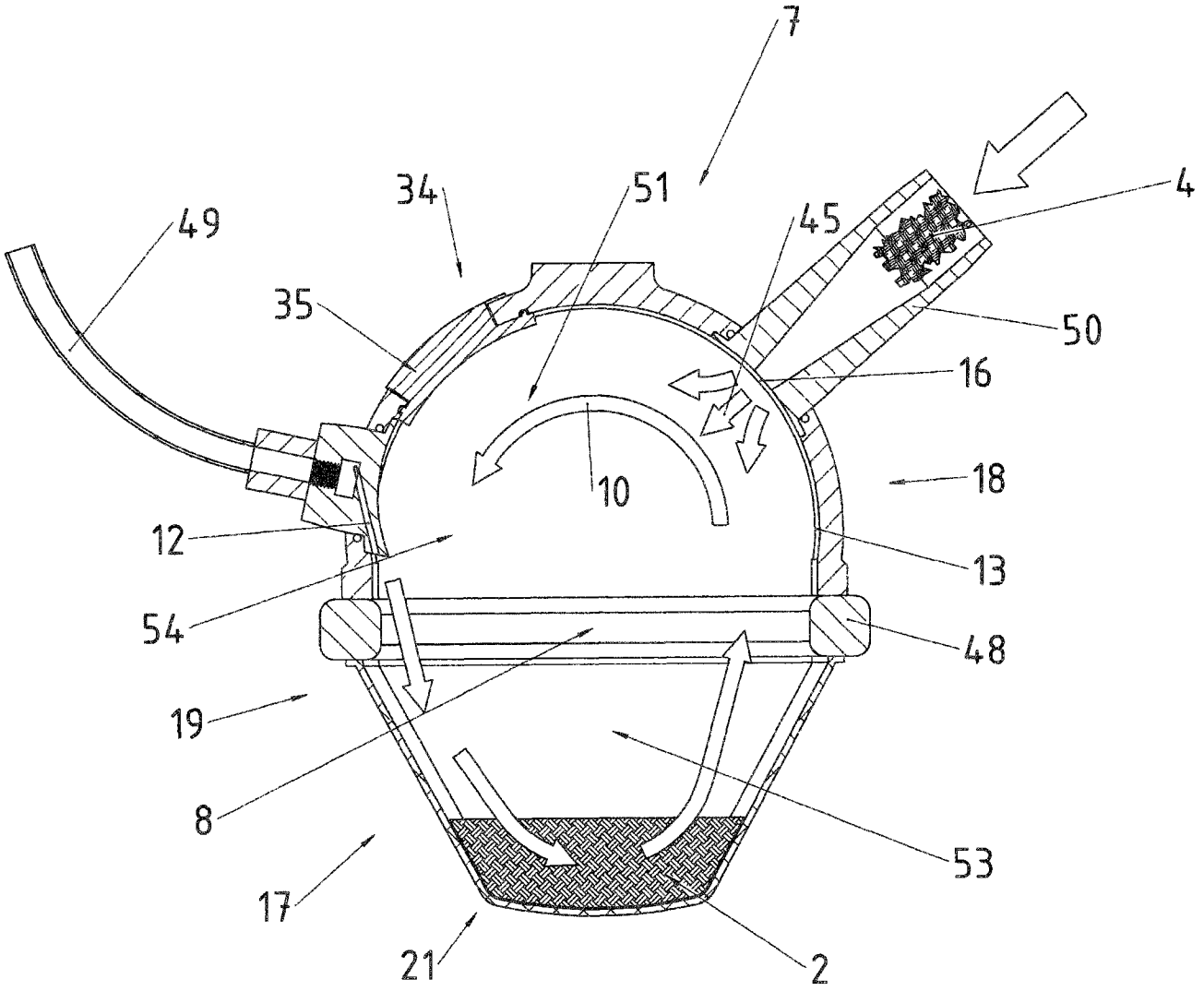

In the embodiments of the FIGS. 6 and 7, the additive is added to the tobacco when the tobacco is located in the mixing chamber 8. The additive supplier discharges the additive in the mixing chamber 8 while the closing member 18 is placed in the closing position 19 on the holding member 17, more specifically the tobacco holder 62.

The processing system 1 of FIG. 6 differs from the one shown in FIG. 2, in that the additive supplier transfers the additive 4 in the mixing chamber 8 via a supply opening 46. The supply opening 46 is formed by the vent opening 34. In other example, the supply opening 46 is separate from the vent opening 34. The supply opening 46 can be opened or closed by a lid 47. The lid 47 is pivotally movable from a closing position into an open position, and vise versa (arrow 51). The lid 47 is formed by the filter 35 of the vent opening 34. For supplying the additive 4 in the mixing chamber 8, the lid 47 is moved to open the supply opening 46 in order to allow access to the additive 4. After that, the additive 4 is transferred into the mixing chamber 8 via the supply opening 46. During the mixing of the tobacco 2 and additive 4 by the gas stream 10, the supply opening 46 is closed by the lid 47.

The processing system of FIG. 7 differs from the one shown in FIG. 2, in that the additive supplier transfers the additive 4 into the mixing chamber 8 via the further gas openings 16. In other examples, the additive 4 is discharged into the mixing chamber 8 via the at least one gas opening 12 and/or the at least one further gas opening 16. This way, the additive is transported into the mixing chamber 8 via the gas stream and/or further gas stream. This tends to be an efficient way of supplying an additive 4 in fluid form, more specifically in liquid form, into the mixing chamber 8.

Figure 8:
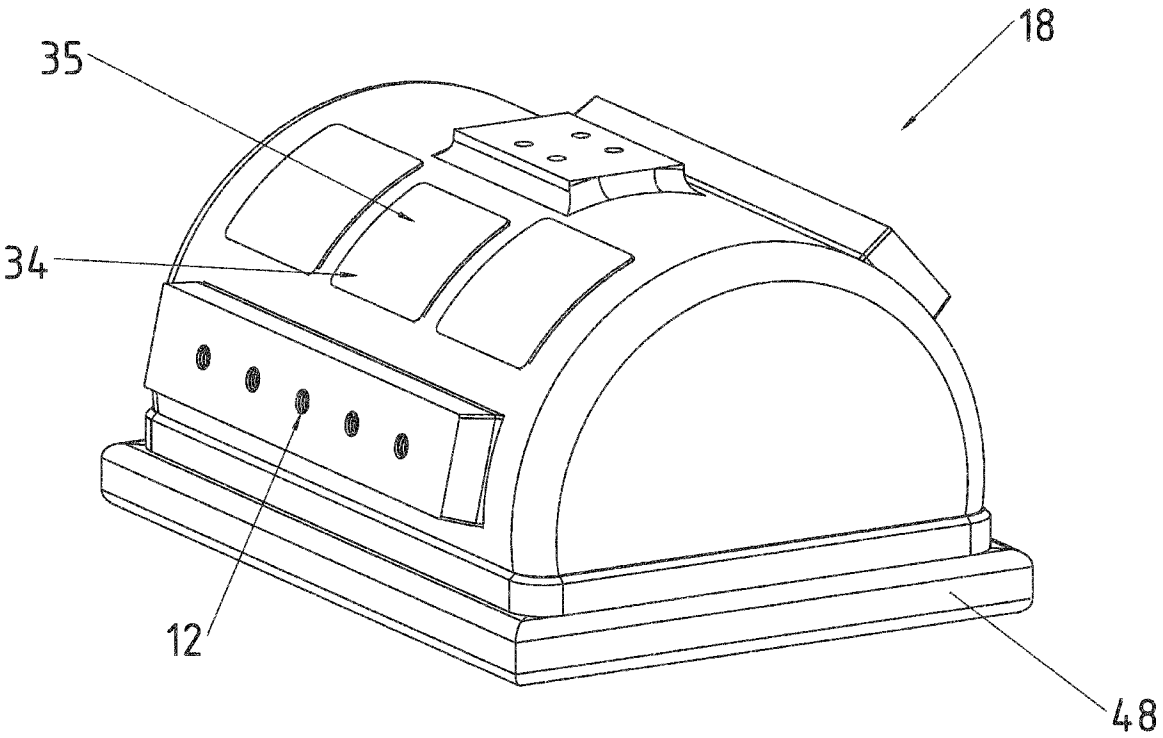
Figure 9:
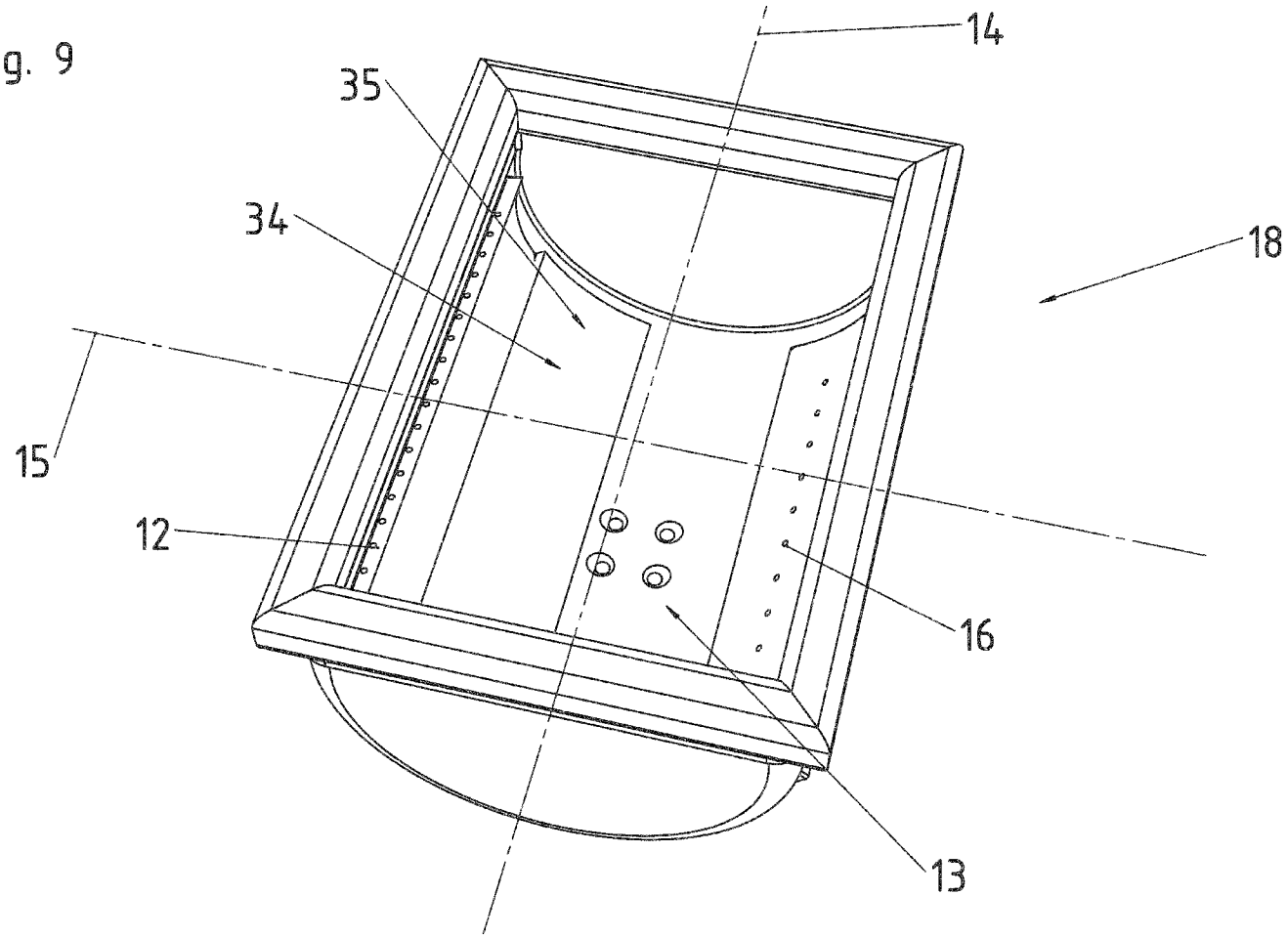

FIG. 8 shows the outer side of the closing member 18 and FIG. 9 shows the inner side of the closing member 18 of the processing system of FIG. 2. The mixing house 7 comprises a length direction 14 and a width direction 15. The mixing house 7 comprises multiple gas openings 12 which are located at a distance from each other in the length direction 14. The gas openings 12 are positioned along a line extending in the length direction 14. The gas openings 12 extend over the majority of the length direction 14. The gas openings 12 extend around 75% of the length direction 14. In other examples, the gas openings 12 extend between 50% and 100% of the length direction 14.

In a further embodiment, the gas openings 12 are located at a distance from each other in the width direction 15. The gas openings 12 extend over the majority of the width direction 15. The gas openings 12 extend around 75% of the width direction 15. In other examples, the gas openings 12 extend between 50% and 100% of the width direction 15.

The mixing house 7 comprises multiple further gas openings 16 which are located at a distance from each other in the length direction 14. The further gas openings 16 are positioned along a line extending in the length direction 14. The further gas 16 openings extend over the majority of the length direction 14. The further gas openings 16 extend around 75% of the length direction 14. In other examples, the further gas openings 16 extend between 50%-100% of the length direction 14.

In a further embodiment, the further gas openings 16 are located at a distance from each other in the width direction 15. The further gas openings 16 extend over the majority of the width direction 15. The further gas openings 16 extend around 75% of the width direction 15. In other examples, the further gas openings 16 extend between 50%-100% of the width direction 15.

Figure 10:
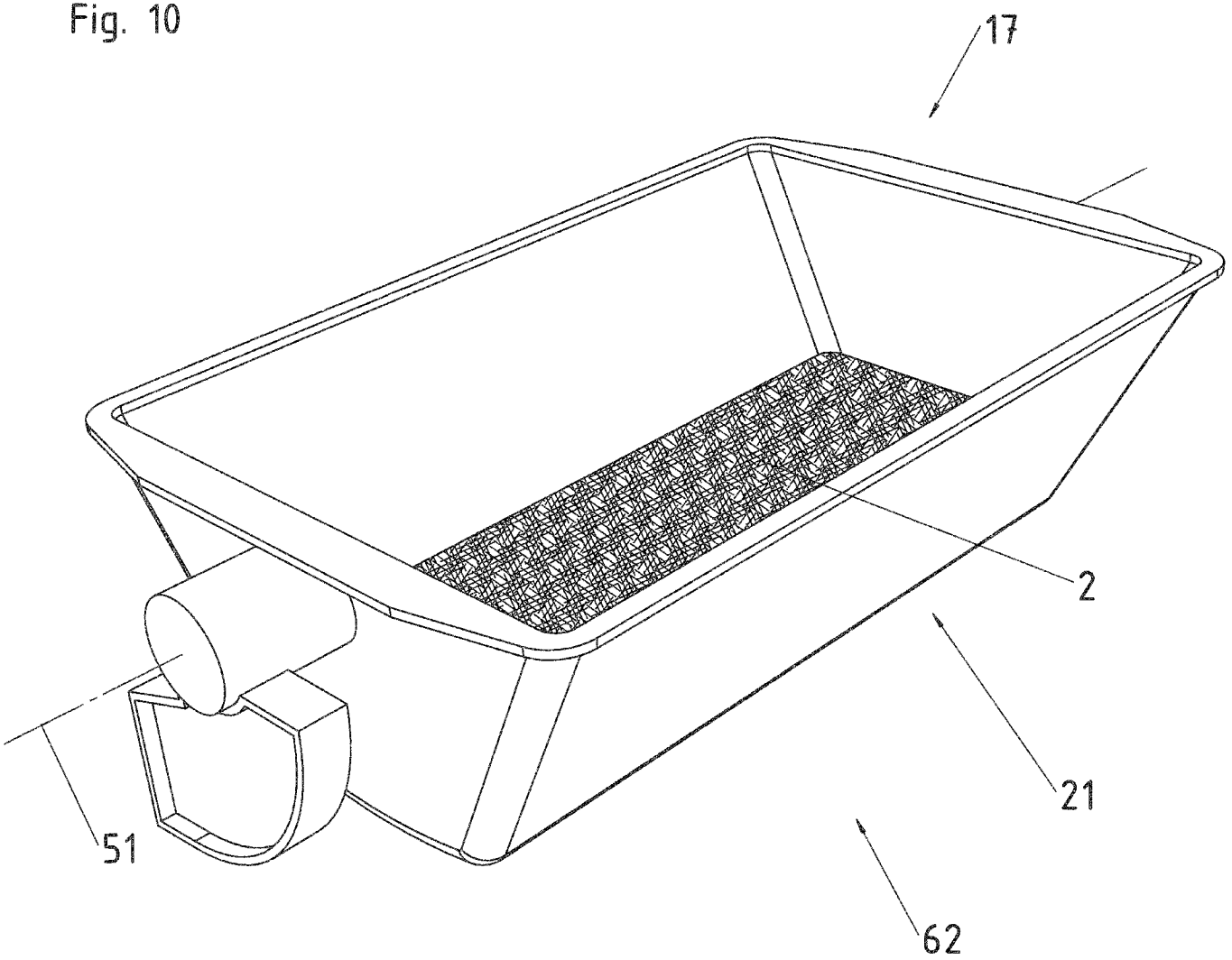

FIG. 10 shows the holding member 17 of the processing system of FIG. 2. The holding member 17 is formed by the tobacco holder 62 of the transport device 32, more specifically the tray 21 of the tray transporter 20. The tray 21 is configured to hold one dose of tobacco 2. In the tray transporter 20, the tray 21 is arranged pivotable about a pivot axis 51.

Figure 11:
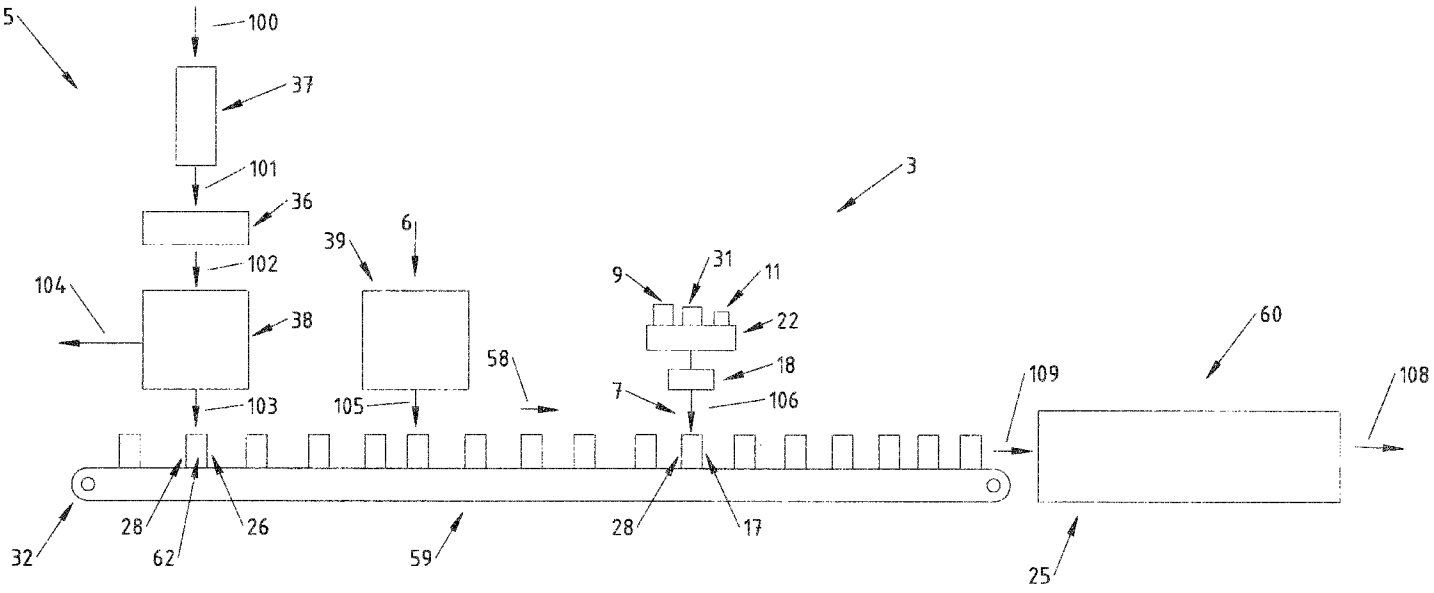

FIG. 11 shows a further embodiment of the tobacco processing system according to the invention. The processing system 1 differs from the one shown in FIG. 1, in that the tobacco holder 62 are tobacco packages 26. The weighing device 38 transfers the doses of tobacco into a tobacco package 26 (arrow 103). In the shown situation, the tobacco package 26 is a tobacco bin 28. The transport device 32 is a package transporter 59. The tobacco bins 28 are transported by the package transporter 59 in the direction of arrow 58. The tobacco bins 28 are moved to the additive supply unit 39 which adds the additive to the tobacco located in the tobacco bins 28 (arrow 105). The package transporter 59 subsequently moves the tobacco bins 28 to the mixing device 3. The tobacco and additive are mixed by the mixing device 3 within the tobacco bins 28 (arrow 106). This means that the tobacco packages 26, more specifically the tobacco bins 28, form the holder member 17 of the mixing device 3. The tobacco bins 28 with the mixed tobacco and additive are moved to a sealing device 60 (arrow 109) to seal the tobacco bins 28. Sealed tobacco bins 28 containing mixed tobacco and additive leave the sealing device 60 (arrow 108). In this situation, the packaging device 25 is formed by the package transporter 59 and the sealing device 60.

Figure 12:
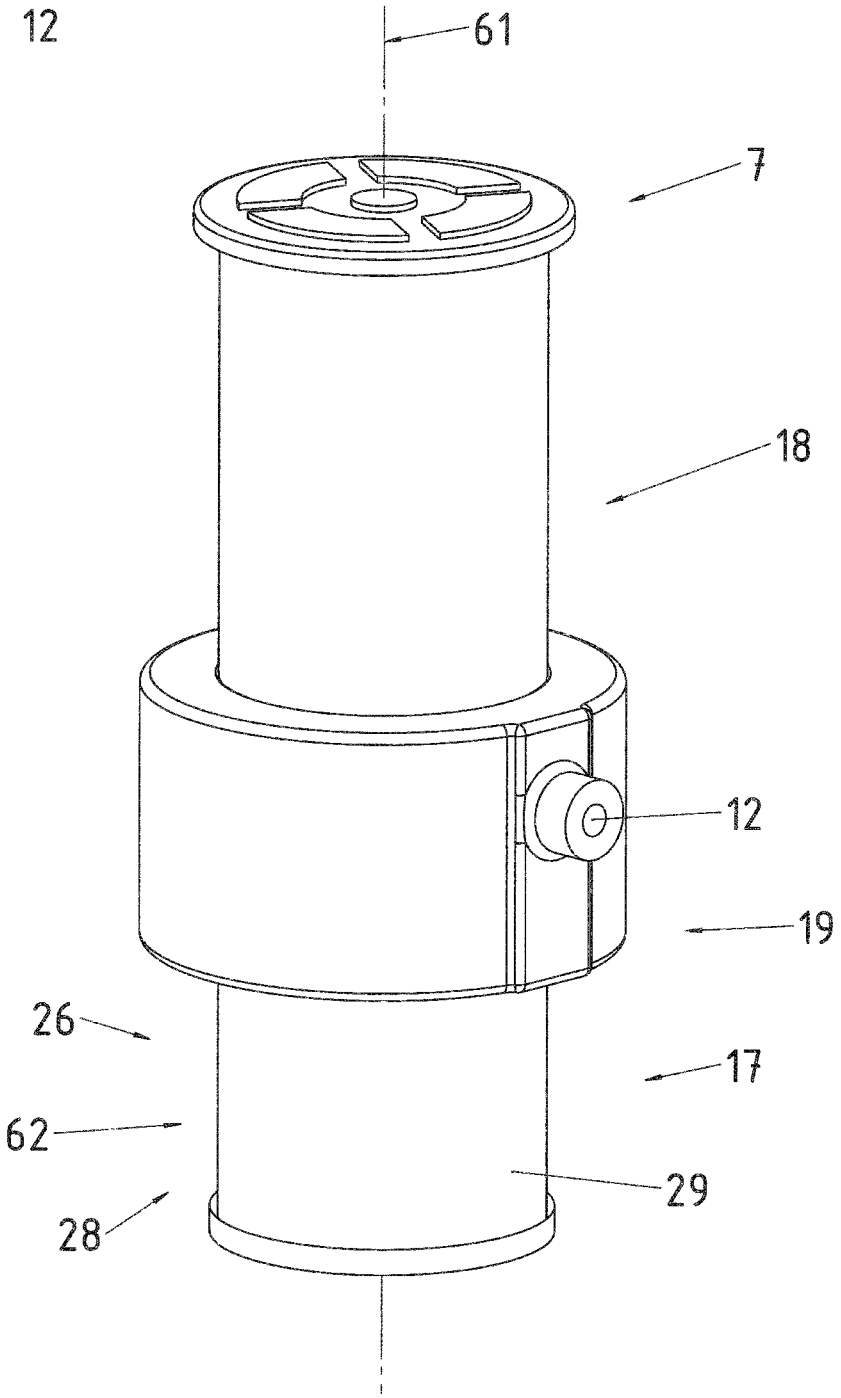
Figure 13:
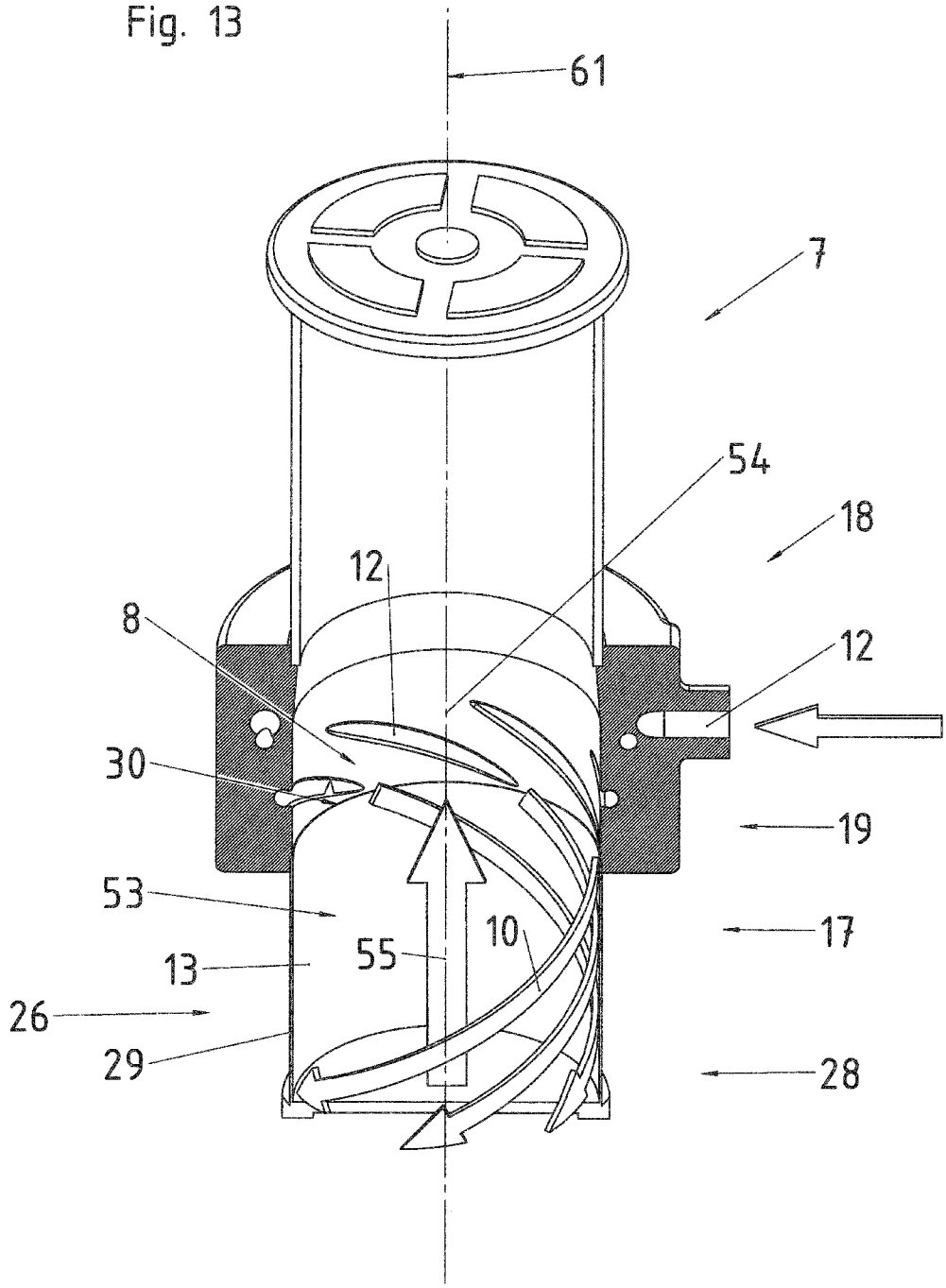

FIG. 12 shows a view in perspective of the mixing housing of the tobacco processing system of FIG. 11. FIG. 13 schematically shows a view in cross section of the mixing housing of FIG. 12. The holding member 17 is formed by one of the tobacco packages 26 in which the doses of tobacco are placed. The tobacco package 26 is a tobacco bin 28. The tobacco bin 28 comprise bin walls 29 defining a bin opening 30 and the closing member 18 is in the closing position 19 placed on or in the bin opening 30. The gas openings 12 are provided in the closing member 18 and positioned to create a vortex-like gas stream 10 in the mixing chamber 8. The mixing chamber 8 comprises a longitudinal axis 61 and the vortex-like gas stream 10 rotates around the longitudinal axis 61.

The tobacco bin 28 (as being the holding member 17) comprises a first inner space 53 and the closing member 18 comprises a second inner space 54. The first inner space 53 and the second inner space 54 from the mixing chamber 8. The mixing device 3 is configured to provide a vortex-like gas steam 10 which lifts the tobacco and additive from the first inner space 53 into the second inner space 54 (arrow 55).

The volume of the mixing chamber 8 is at least 1.5 times larger than the volume of the tobacco and additive placed in the mixing chamber 8.

The volume of the mixing chamber 8 is at most 10 times larger than the volume of the tobacco and additive placed in the mixing chamber 8.

In this embodiment, the tobacco and additive are transferred into the tobacco bin 28 before the closing member 18 is placed in the closing position 19. In other examples of the processing system 1, the additive is added to the tobacco while the closing member 18 is placed in the closing position 19. This can be achieved in similar ways a shown in FIGS. 6 and 7.

Figure 14:
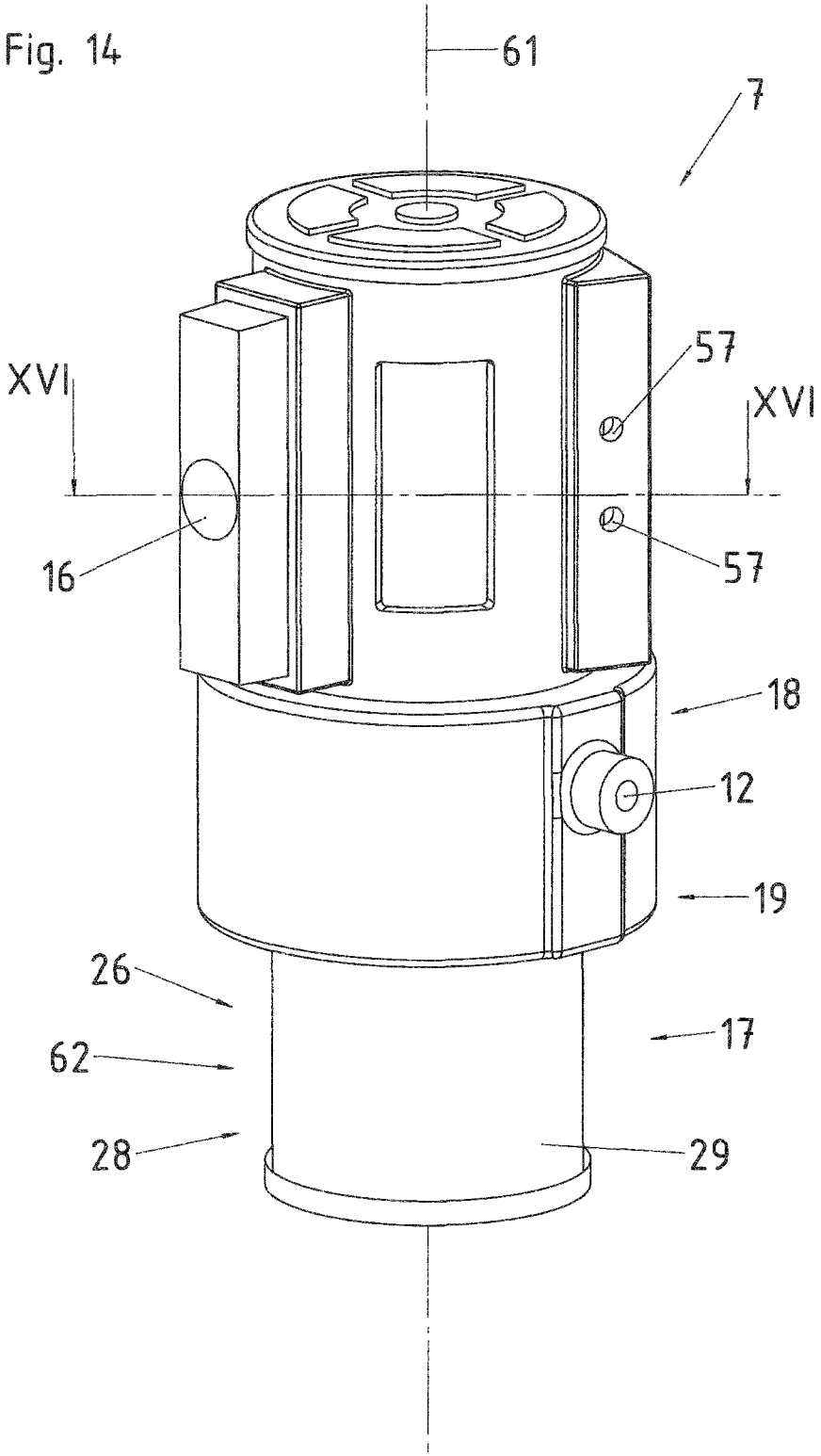
Figure 15:
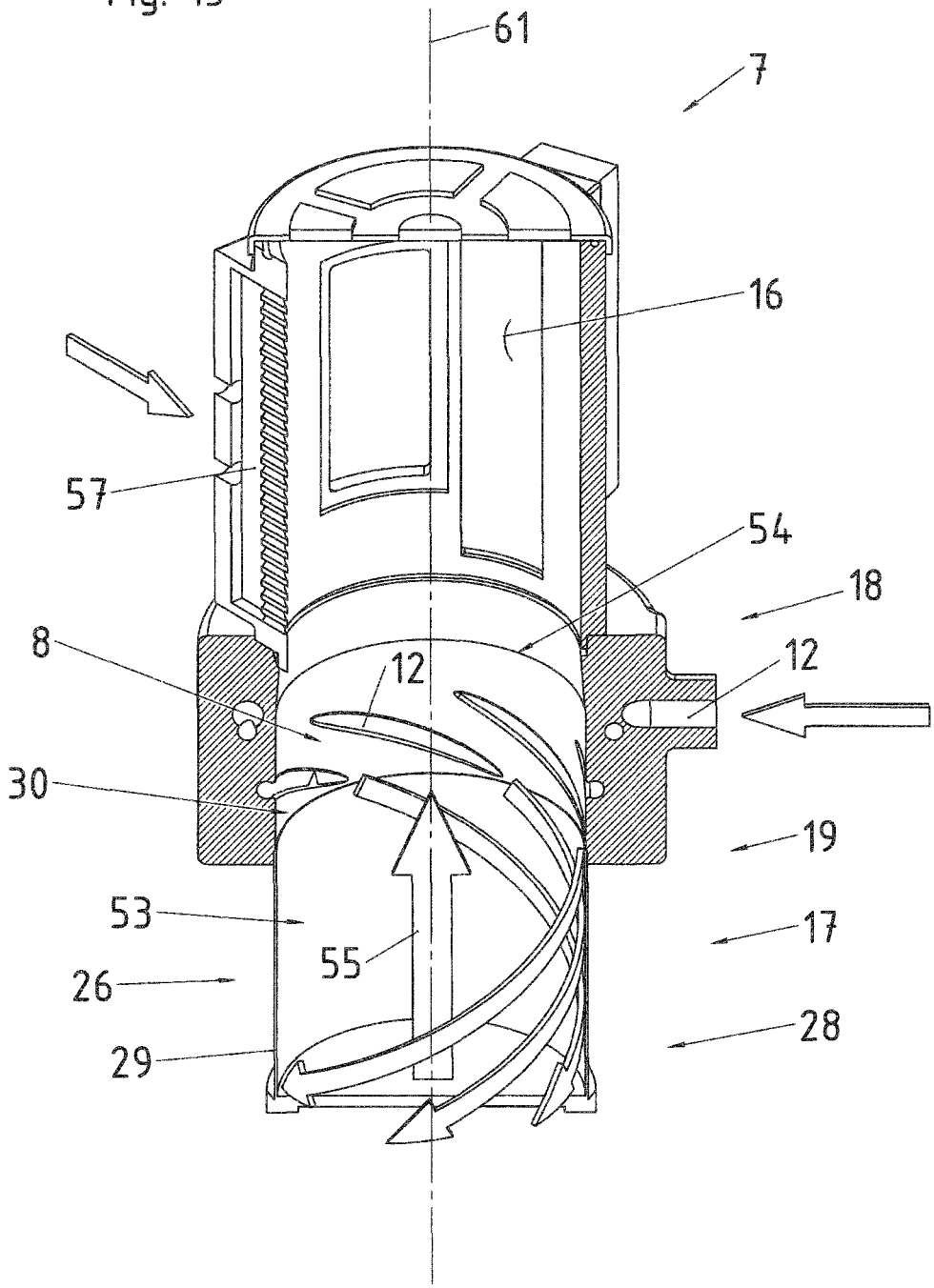
Figure 16:
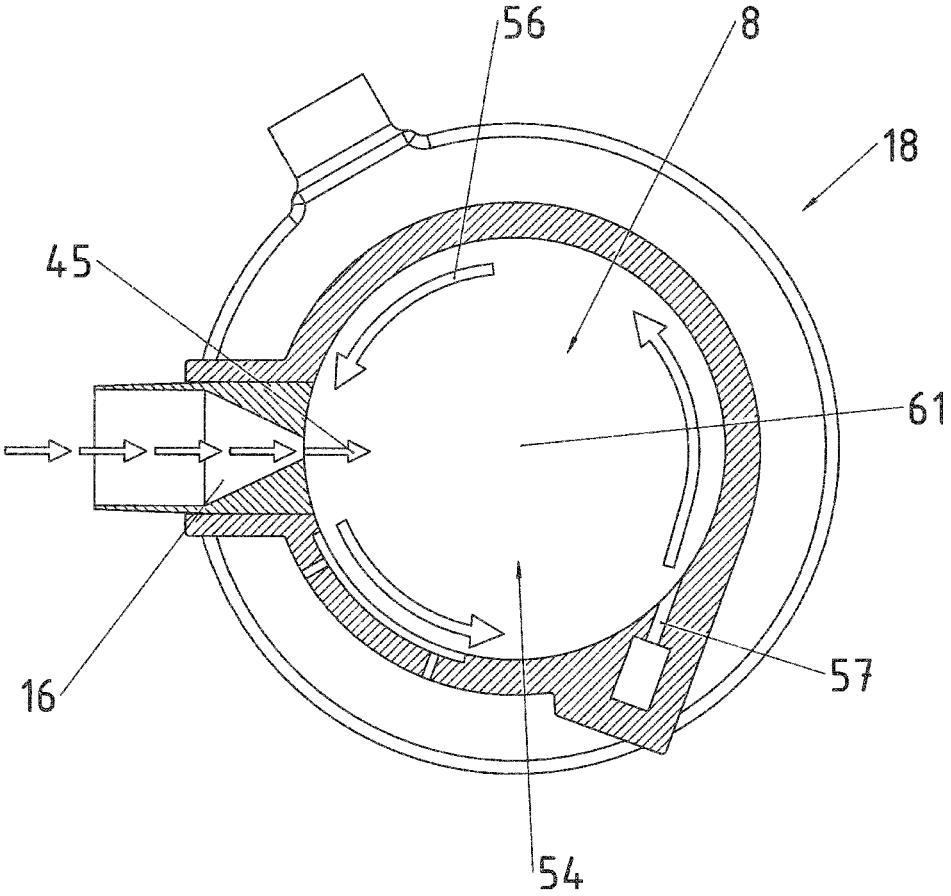

FIG. 14 shows a view in perspective of a further embodiment of the mixing housing of the tobacco processing system of FIG. 11. FIG. 15 shows a view in cross section of the mixing housing 7 of FIG. 14. FIG. 16 shows a view in cross section along line XVI-XVI of the mixing housing of FIG. 15. The mixing housing 7 differs from the one of FIG. 12, in that at least one further gas opening 16 and at least one auxiliary gas opening 57 is provided.

The further gas opening 16 is operatively connected to the gas stream unit 9 to provide a further gas stream 45 in the mixing chamber 8. The further gas stream extends transverse to the vortex-like gas steam 10. The further gas opening 16 extend transverse to the longitudinal axis 61. The further gas opening 16 is located in the second inner space 54.

The auxiliary gas openings 57 are operatively connected to the gas stream unit 9 to provide an auxiliary gas stream 56 in the mixing chamber 8. The auxiliary gas stream 56 is a circulating gas stream which facilitates the vortex-like gas stream 10 in the mixing chamber 8. The auxiliary gas stream 56 circulates around the longitudinal axis 64. The further gas openings 57 are located in the second inner space 54.

In other examples, the mixing housing 7 only comprises one or more further gas openings or one or more auxiliary openings besides the gas stream openings.

In this embodiment, the tobacco and additive are transferred into the tobacco bin 28 before the closing member 18 is placed in the closing position 19. In other examples of the processing system 1, the additive is added to the tobacco while the closing member 18 is placed in the closing position 19. This can be achieved in similar ways a shown in FIGS. 6 and 7.

Figure 17:
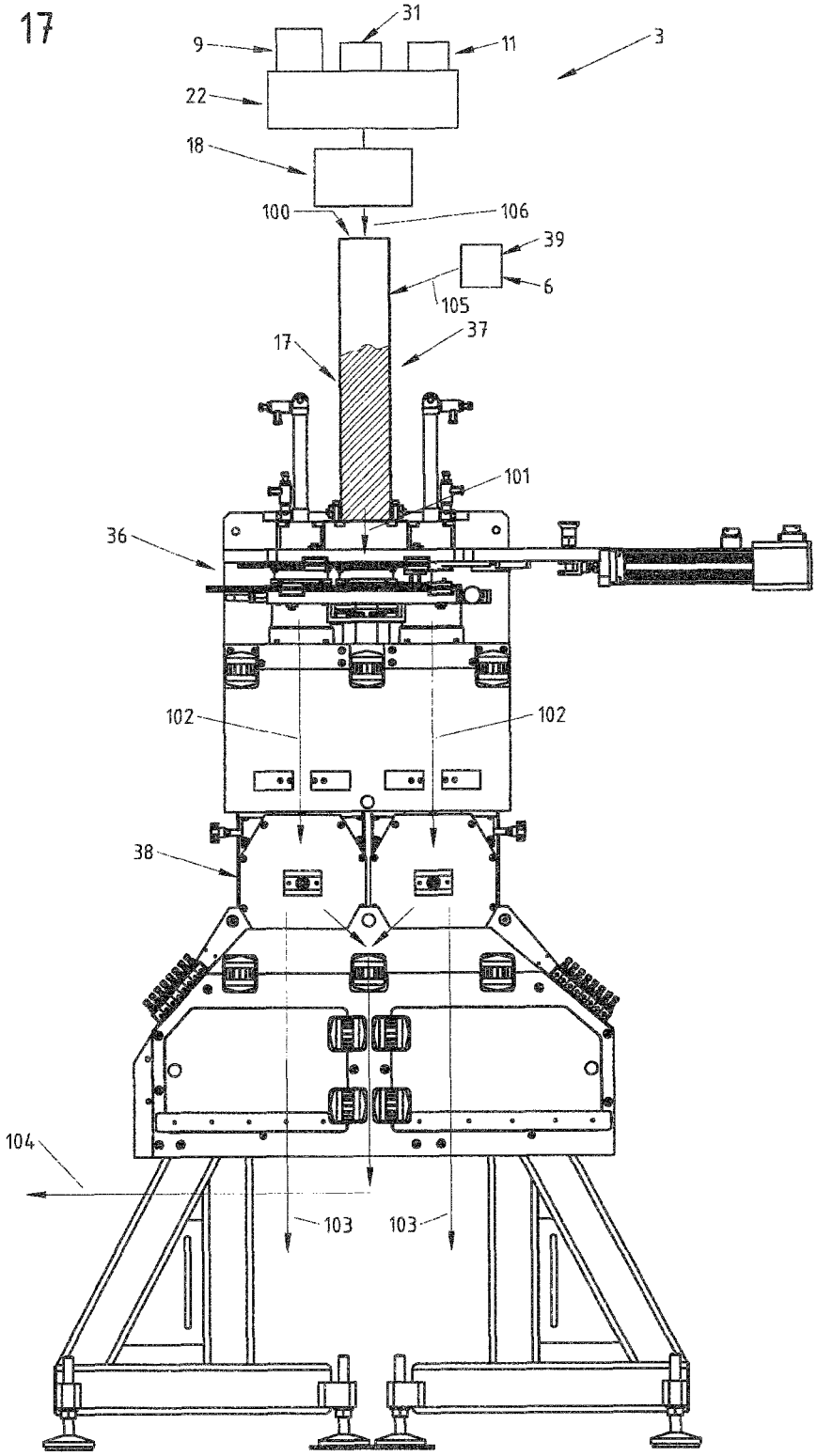

FIG. 17 shows a side view of a further embodiment of the tobacco processing system according to the invention. The processing system differs from the one shown in FIG. 1, in that the additive supply unit 39 is configured to supply the additive into the tobacco storage 37, and the mixing device 3 is configured to mix the tobacco and additive in the mixing chamber 8 wherein the holder member 17 is formed by the tobacco storage 37.

The following clauses form a further description of the tobacco processing system and method according to the invention.

Clause 1. Tobacco processing system for processing tobacco, which processing system comprises;

a tobacco mixing device for mixing an additive in the tobacco, a tobacco supplier for supplying the tobacco to the mixing device, and an additive supplier for supplying the additive to the mixing device, wherein the mixing device comprises a mixing housing which encloses the tobacco and additive to form a mixing chamber in which the tobacco and additive are mixed and a gas stream unit which is operatively connected to the mixing housing and configured to provide a gas stream which moves the tobacco and additive through the mixing chamber.

Clause 2. Tobacco processing system according to clause 1, wherein the mixing device is configured to lift the tobacco inside the mixing chamber via the gas stream.

Clause 3. Tobacco processing system according to clause 1 or 2, wherein the gas stream unit comprises a controller to control the gas stream in the mixing chamber such that a pulsating gas stream is provided.

Clause 4. Tobacco processing system according to clause 3, wherein the pulsating gas stream has between 2 and 5 gas stream pulses per second.

Clause 5. Tobacco processing system according to any of the preceding clauses, wherein the mixing housing comprises at least one gas opening which is operatively connected with the gas stream unit.

Clause 6. Tobacco processing system according to clause 5, wherein the at least one gas opening is positioned to create a circulating gas stream in the mixing chamber.

Clause 7. Tobacco processing system according to clause 6, wherein the mixing housing comprises inner housing walls which define the mixing chamber and are formed to facilitate the circulating flow of the gas stream.

Clause 8. Tobacco processing system according to clause 5, wherein the at least one gas opening is positioned to create a vortex-like gas stream in the mixing chamber.

Clause 9. Tobacco processing system according to clause 8, wherein the mixing housing comprises inner housing walls which define the mixing chamber and are formed to facilitate the vortex-like flow of the gas stream.

Clause 10. Tobacco processing system according to any of the clauses 5-7, wherein the mixing housing comprises multiple gas openings, a length direction and a width direction, and the gas openings are located at a distance from each other in the length direction or the width direction.

Clause 11. Tobacco processing system according to any of the clauses 5, 8 or 9, wherein the mixing housing comprises multiple gas openings, a longitudinal axis and the gas openings surround the longitudinal axis.

Clause 12. Tobacco processing system according to any of the preceding clauses, wherein the mixing housing comprises at least one further gas opening which is operatively connected to the gas stream unit and positioned to provide a further gas stream in a direction transverse to the gas stream.

Clause 13. Tobacco processing system according to clause 12, wherein the gas steam unit comprises a further controller which is configured to control the further gas stream in the mixing chamber such that a pulsating further gas stream is provided.

Clause 14. Tobacco processing system according to clause 13, wherein the pulsating further gas stream has between 5 and 15 gas stream pulses per second.

Clause 15. Tobacco processing system according to any of the preceding clauses, wherein the mixing housing is formed by a holding member for holding the tobacco and a closing member placed in a closing positing in which the tobacco is enclosed by the holding member and the closing member.

Clause 16. Tobacco processing system according to clause 15, wherein the mixing device is configured to provide the gas stream in the mixing chamber while the closing member is located in the closing position.

Clause 17. Tobacco processing system according to clause 15 or 16, wherein the holding member comprise a first inner space wherein the tobacco is positioned, the closing member comprises a second inner space, the mixing chamber is formed by the first inner space and second inner space and the mixing device is configured to lift the tobacco from the first inner space into the second inner space via the gas stream.

Clause 18. Tobacco processing system according to any of the preceding clauses, wherein the processing system comprises a dosing device for forming doses of tobacco and a transport device for transporting the doses of tobacco in tobacco holders through at least part of the processing system and the holding member is formed by one of the tobacco holders.

Clause 19. Tobacco processing system according to clause 18 in combination with clause 15, wherein the mixing device is configured to provide the gas stream in the mixing chamber while the closing member is located in the closing position and moved along with the tobacco holder.

Clause 20. Tobacco processing system according to clause 19, wherein the mixing device comprises a member mover to place the closing member in the closing position on one of the moving tobacco holders while moving the closing member along with the tobacco holder over a predetermined distance.

Clause 21. Tobacco processing system according to clause 20, wherein the member mover moves the closing member along an endless path in which, after being moved along with the tobacco holder while being in the closing position, the closing member is moved back in the opposite direction of the movement of the tobacco holders while being located at a distance from the tobacco holders in order to be placed in the closing position on a further one of the tobacco holders and to repeat the cycle.

Clause 22. Tobacco processing system according to clause 20 or 21, wherein the mixing device comprises multiple closing members and the member mover is configured to move the closing members synchronously in the same direction such that the closing members together with several of the tobacco holders form multiple mixing chambers.

Clause 23. Tobacco processing system according to any of the preceding clauses 18-22, wherein the transport device is a tray transporter and the tobacco holders are trays moved by the tray transporter through at least part of the processing system.

Clause 24. Tobacco processing system according to any of the clauses 18-22, wherein the transport device is a package transporter and the tobacco holders are tobacco packages moved by the package transporter through at least part of the processing system.

Clause 25. Tobacco processing system according to clause 24, wherein the tobacco packages are tobacco bins.

Clause 26. Tobacco processing system according to clause 25, wherein the tobacco bin comprises a bin wall defining a bin opening and the closing member in the closing position is placed on or in the bin opening.

Clause 27. Tobacco processing system according to any of the preceding clauses and in combination with clause 15, wherein the additive supplier is configured to add the additive to the tobacco when the tobacco is located in the holding member.

Clause 28. Tobacco processing system according to any of the clauses 1-26, wherein the additive supplier is configured to add the additive to the tobacco when the tobacco is located in the mixing chamber.

Clause 29. Tobacco processing system according to any of the clauses 1-17, 19-26 and in combination with clause 18, wherein the additive supplier is configured to add the additive to the tobacco when the tobacco is located in the tobacco holder Clause 30. Tobacco processing system according to any of the clauses 1-22, 24-26 and in combination with clause 23, wherein the additive supplier is configured to add the additive to the tobacco when the tobacco is located in the tray Clause 31. Tobacco processing system according to any of the clauses 1-23, 25-26 and in combination with clause 24, wherein the additive supplier is configured to add the additive to the tobacco when the tobacco is located in the tobacco package.

Clause 32. Tobacco processing system according to any of the clauses 1-24, 26 and in combination with clause 25, wherein the additive supplier is configured to add the additive to the tobacco when the tobacco is located in the tobacco bin.

Clause 33. Tobacco processing system according to any of the preceding clauses, wherein the additive is added to the tobacco in the mixing chamber via the gas stream.

Clause 34. Tobacco processing system according to any of the preceding clauses, wherein the additive is added to the tobacco in the mixing chamber via the further gas stream.

Clause 35. Tobacco processing system according to any of the preceding clauses, wherein the volume of the mixing chamber is at least 1.5 times larger than the volume of the tobacco and additive placed in the mixing chamber.

Clause 36. Tobacco processing system according to any of the clauses 1-14, 16, 17, 27, 28, 33-35 and in combination with clause 15, wherein the processing system comprises a dosing device for forming doses of tobacco and a tobacco storage for storage of the tobacco and passing it to the dosing device, the additive supplier is configured to supply the additive into the tobacco storage, and the holder member is formed by the tobacco storage.

Clause 37. Method of processing tobacco, which method comprises the steps of;

providing a tobacco processing system according to any of the preceding clauses, supplying tobacco into the mixing chamber of the mixing device, supplying an additive into the mixing chamber of the mixing device, providing a gas stream in the mixing chamber with the gas stream unit to move the tobacco and the additive through the mixing chamber.

Clause 38. Method according to clause 37, wherein the tobacco is lifted inside the mixing chamber via the gas stream.

Clause 39. Method according to clause 37 or 38, wherein the provided tobacco processing system at least comprises the features of clause 15 and the method comprises enclosing the tobacco with the mixing housing formed by the holding member for holding the tobacco and the closing member placed in a closing positing in contact with the holding member to enclose the tobacco.

Clause 40. Method according to clause 39, wherein the provided tobacco processing system at least comprises the features of clause 18 and the method comprises transporting doses of tobacco in the tobacco holders through at least part of the processing system with the transport device and forming the holder member with one of the tobacco holders.

Clause 41. Method according to clause 40, wherein the transport device is a tray transporter and the tobacco holders are trays moved by the tray transporter through at least part of the processing system and the method comprises mixing the tobacco and additive while one of the trays forms the holder member.

Clause 42. Method according to clause 40, wherein the transport device is a package transporter and the tobacco holders are tobacco packages moved by the package transporter through at least part of the processing system and the method comprises mixing the tobacco and additive while one of the tobacco packages forms the holder member.

Clause 43. Method according to clause 42, wherein the tobacco packages are tobacco bins and the method comprise mixing the tobacco and additive while one of the tobacco bins forms the holder member.

The invention claimed is:

1. A tobacco processing system for processing tobacco, which processing system comprises;

a tobacco mixing device for mixing an additive in the tobacco, a tobacco supplier for supplying the tobacco to the mixing device, and an additive supplier for supplying the additive to the mixing device, wherein the mixing device comprises a mixing housing which encloses the tobacco and additive to form a mixing chamber in which the tobacco and additive are mixed and a gas stream unit which is operatively connected to the mixing housing and configured to provide a gas stream which moves the tobacco and additive through the mixing chamber, wherein the mixing housing is formed by a holding member for holding the tobacco and a closing member placed in a closing positing in which the tobacco is enclosed by the holding member and the closing member, wherein the processing system comprises a dosing device for forming doses of tobacco and a transport device for transporting the doses of tobacco in tobacco holders through at least part of the processing system and the holding member is formed by one of the tobacco holders, wherein the mixing device is configured to provide the gas stream in the mixing chamber while the closing member is located in the closing position and the closing member is moved along with the tobacco holder, and wherein the mixing device comprises a member mover to place the closing member in the closing position on one of the moving tobacco holders while moving the closing member along with the tobacco holder over a predetermined distance.

2. The tobacco processing system according to claim 1, wherein the mixing device is configured to lift the tobacco inside the mixing chamber via the gas stream.

3. The tobacco processing system according to claim 1, wherein the gas stream unit comprises a controller to control the gas stream in the mixing chamber such that a pulsating gas stream is provided and the pulsating gas stream has between 2 and 5 gas stream pulses per second.

4. The tobacco processing system according to claim 1, wherein the mixing housing comprises at least one gas opening which is operatively connected with the gas stream unit.

5. The tobacco processing system according to claim 1, wherein;

the mixing housing comprises at least one further gas opening which is operatively connected to the gas stream unit and positioned to provide a further gas stream in a direction transverse to the gas stream, the gas steam unit comprises a further controller which is configured to control the further gas stream in the mixing chamber such that a pulsating further gas stream is provided, and the pulsating further gas stream has between 5 and 15 gas stream pulses per second.

6. The tobacco processing system according to claim 1, wherein the holding member comprise a first inner space wherein the tobacco is positioned, the closing member comprises a second inner space, the mixing chamber is formed by the first inner space and second inner space and the mixing device is configured to lift the tobacco from the first inner space into the second inner space via the gas stream.

7. The tobacco processing system according to claim 1, wherein;

the member mover moves the closing member along an endless path in which, after being moved along with the tobacco holder while being in the closing position, the closing member is moved back in the opposite direction of the movement of the tobacco holders while being located at a distance from the tobacco holders in order to be placed in the closing position on a further one of the tobacco holders and to repeat the cycle, and the mixing device comprises multiple closing members and the member mover is configured to move the closing members synchronously in the same direction such that the closing members together with several of the tobacco holders form multiple mixing chambers.

8. The tobacco processing system according to claim 1, wherein the transport device is a tray transporter and the tobacco holders are trays moved by the tray transporter through at least part of the processing system.

9. The tobacco processing system according to claim 1, wherein;

the transport device is a package transporter and the tobacco holders are tobacco packages moved by the package transporter through at least part of the processing system, the tobacco packages are tobacco bins, and the tobacco bin comprises a bin wall defining a bin opening and the closing member in the closing position is placed on or in the bin opening.

10. The tobacco processing system according to claim 1, wherein the additive supplier is configured to add the additive to the tobacco when the tobacco is located in the mixing chamber.

11. The tobacco processing system according to claim 1, wherein the additive supplier is configured to supply the additive into the tobacco storage, and wherein the holder member is formed by the tobacco storage.

12. A method of processing tobacco, which method comprises the steps of;

providing a tobacco processing system according to claim 1, supplying tobacco into the mixing chamber of the mixing device, supplying an additive into the mixing chamber of the mixing device, and providing a gas stream in the mixing chamber with the gas stream unit to move the tobacco and the additive through the mixing chamber.

13. The method according to claim 12, wherein the tobacco is lifted inside the mixing chamber via the gas stream.

14. The method according to claim 12, wherein the method comprises enclosing the tobacco with the mixing housing formed by the holding member for holding the tobacco and the closing member placed in a closing position in contact with the holding member to enclose the tobacco.

15. The method according to claim 14, wherein the method comprises transporting doses of tobacco in the tobacco holders through at least part of the processing system with the transport device and forming the holder member with one of the tobacco holders.

16. The method according to claim 15, wherein the transport device is a tray transporter and the tobacco holders are trays moved by the tray transporter through at least part of the processing system and the method comprises mixing the tobacco and additive while one of the trays forms the holder member.

17. The method according to claim 15, wherein the transport device is a package transporter and the tobacco holders are tobacco packages moved by the package transporter through at least part of the processing system and the method comprises mixing the tobacco and additive while one of the tobacco packages forms the holder member.

* * * * *